US005313893A

United States Patent [19]

Kaneda et al.

[11] Patent Number: 5,313,893

[45] Date of Patent: May 24, 1994

[54] DESK

[75] Inventors: Shinichi Kaneda, Nara; Shouji Tamaki, Osaka; Osamu Sakai, Ashiya, all of Japan

[73] Assignee: Kokuyo Co., Ltd., Osaka, Japan

[21] Appl. No.: 971,853

[22] PCT Filed: May 13, 1991

[86] PCT No.: PCT/JP91/00630

§ 371 Date: Jan. 8, 1993

§ 102(e) Date: Jan. 8, 1993

[87] PCT Pub. No.: WO92/20257

PCT Pub. Date: Nov. 26, 1992

[51] Int. Cl.[5] ..... A47B 5/00

[52] U.S. Cl. ..... 108/152; 108/157

[58] Field of Search ..... 108/153, 154, 155, 156, 108/157; 403/380, 375

[56] References Cited

U.S. PATENT DOCUMENTS 580,018 4/1887 Sutton et al. ..... 108/157
1,956,164 4/1934 Voight ..... 108/152

FOREIGN PATENT DOCUMENTS 1295397 5/1962 France ..... 108/157
48-32303 4/1973 Japan .
54-89868 7/1979 Japan .
8404028 11/1984 World Int. Prop. O. ..... 108/157

*Primary Examiner*—Kenneth J. Dorner

*Assistant Examiner*—Gerald A. Anderson

*Attorney, Agent, or Firm*—Wegner, Cantor, Mueller & Player

[57] ABSTRACT

The desk comprises a top plate and legs which are assembled so as to be able to be disassembled. The desk requires a reduced number of parts to connect the top plate and the legs, so that the labor required for assembly and disassembly may be reduced. To this end the top plate has sufficient rigidity, and each of the legs is provided with an upwardly facing surface adapted to be brought into contact with the under surface of the top plate and at the top end thereof with an arm extending along the front edge of the top plate. The top plate and the legs are connected by tapered engaging means and claw-type engaging means. The tapered engaging means comprises a concavely tapered surface formed in the front edge of the top plate and a convexly tapered surface formed on the arm of each leg, so that the two surfaces are brought into close contact with each other by sliding the leg relative to the top plate toward the user's side. The claw-type engaging means comprises bent claws formed on the upper surface of each leg and claw-receiving holes formed in the under surface of the top plate, so that the claws may be brought into engagement in the holes by sliding the leg relative to the top plate toward the user's side. Upon engagement of the engaging means, the above-mentioned arm is securely fixed to the front edge of the top plate by a fastener.

21 Claims, 41 Drawing Sheets

DESK

FIELD OF THE ART

This invention relates to a desk in which the top plate and the legs can be assembled and disassembled.

BACKGROUND ART

In prior art desks of this type it is customary to connect right and left legs by cross members, on which a top plate is placed and fixed to them.

In other words, in the prior art desks legs and various types of cross members are combined to form a rigid body, on which a top plate is mounted.

In the prior art the top plate is so designed as to be reinforced by cross members, so that it is apt to be curved or warped unless it is fixed to the cross members at many positions. In addition, unless both the legs are securely fixed to the cross members, it is difficult to give to the body a sufficient degree of rigidity to support the top plate.

Therefore, in the prior art desks, it is customary to use bolts to connect the legs to each other or the top plate to the cross members, so that much time and labor are required for assembly or disassembly.

In offices or the like places many desks of the same standard or design are often connected side by side. To this end it is customary to simply connect the top plates or legs of adjacent desks by using metal fittings. This arrangement leads to a problem that the legs of the connected adjoining desks stand side by side and become so bulky as to reduce usability, with many of the component parts being used redundantly and with a difficulty of making the top plates flush with each other.

In addition to the above inconvenience, in modern offices various office machines are installed which are provided with much wiring. In the previously mentioned conventional desks wires or cables are exposed on the top plate and hang down onto the floor to extend thereon. This is not only unsightly but also obstructive to persons walking on the floor, and if the wires on the floor are trod on or hooked by feet, they are likely to be cut or broken.

The object of the invention is to solve the above problem once and for all.

DISCLOSURE OF THE INVENTION

To attain the above object, the invention has adopted the following construction.

The desk of the invention is provided with a top plate, legs, tapered engaging means, and claw-type engaging means. The top plate has rigidity. Each of the legs is provided with an upwardly facing surface adapted to be in contact with the under surface of the top plate and at the top end thereof with an arm extending along the front edge of the top plate. The tapered engaging means comprises a concavely tapered surface formed in either one of the front edge of the top plate and the arm of each leg, and a convexly tapered surface formed on the other. The concavely and convexly tapered surfaces can be brought into contact with each other by sliding the leg relative to the top plate toward the user's side. The claw-type engaging means comprises bent claws formed on either one of the under surface of the top plate and the upper surface of each leg and claw-receiving holes formed in the other. The claws are brought into engagement with the holes formed by putting the claws into the holes and sliding the leg relative to the top plate toward the user's side. Under the condition that the engaging means are engaged, the previously described arm is fixed by fasteners to the front edge of the top plate.

With the above basic construction, the under surface of the top plate is put on the upwardly facing surface of the leg, and the leg is slid relative to the top plate toward the user's side, whereupon the claws of the claw-type engaging means engage the claw-receiving holes, and at the same time the arm of the leg approaches the front edge of the top plate until the convexly tapered surface of the tapered engaging means enters the concavely tapered surface thereof. Under the condition, the arm is secured by a fastener to the top plate, whereupon the convexly tapered surface closely contacts the concavely tapered surface so that the arm is fixed to the top plate. Since the arm is rigidly fixed to the leg, the secure connection of the arm to the top plate prevents inclination of the leg relative to the top plate. Since the arm is fixed to the front edge of the top plate thereby to prevent forward or rearward movement of the leg, disengagement of the claws from the claw-receiving holes and consequently separation of the upwardly facing surface of the leg from the under surface of the top plate are prevented.

Since the desk of the invention is so constructed that the top plate itself is of construction to provide rigidity, with the legs securely connected to the top plate by means of only the tapered engaging means and the claw-type engaging means, the number of working steps required for manufacture and assembly is greatly reduced as compared with conventional desks, and a relatively small number of component parts suffices to produce at reduced manufacturing cost a desk which is rigid and firm and unlikely to become loose.

The rigid top plate can be the one which comprises a frame faced on the upper and under sides thereof with a metal plate, the one which comprises a steel plate reinforced on the under surface thereof with reinforcing cross members, or the one which is made of wood and has a front edge member made of metal.

The concavely tapered surface may be formed in a V-shaped groove formed in either the front edge of the top plate or the arm of the leg, and the convexly tapered surface may be formed on a ridge formed on either the arm of the leg or the front edge of the top plate.

The bent claws are formed on either one of the under surface of the top plate and the upwardly facing surface of the leg, while the claw-receiving holes are formed in the other. In either case, when the leg is slid relative to the top plate toward the user's side, the claws engages the holes.

A particularly preferable simple fastener may comprise a threaded hole formed in the top plate and a bolt passed through the arm to be screwed into the threaded hole.

In the arrangement that the top plate is provided with reinforcing cross members, the claw-receiving holes may conveniently be formed in the reinforcing cross members. In the arrangement that the top plate is made of wood, recesses are formed in the top plate and covered with a metal plate, in which claw-receiving holes are formed at the positions corresponding to the recesses.

In addition to the previously described basic construction, the desk of the invention is provided with the following components to enable easy connection of adjoining top plates. In the desk of the invention the claws are formed on the upwardly facing surface of the leg in pairs, one of the claws of each pair being spaced a predetermined pitch apart from the other widthwise of the top plate, and the claw-receiving holes are formed in the under surface of the top plate in pairs, one of the holes of each pair being positioned at half the pitch, and the other at one and a half the pitch, from the side edge of the top plate.

In the above arrangement, the upwardly facing surface of the leg is brought into contact with the under surface of the top plate at one side edge portion thereof, and the leg is slid relative to the top plate toward the user's side, whereupon the bent claws engage the holes at two positions, following which the under surface of the top plate is fixed to the upwardly facing surface of the leg as previously described. In like manner another leg is fixed to the other side edge portion of the top plate, whereupon a rigid desk comprising a single top plate and a left and a right leg is formed.

If a plurality of top plates are to be connected continuously, a leg is fixed to one side edge portion of a first top plate, the under surface of the other side edge portion of which is placed on half the upwardly facing surface of a second leg. Under the condition, the leg is slid relative to the top plate toward the user's side, whereupon due to the previously described dimensional arrangement of the claw-type engaging means, one of each paired claws engages the corresponding claw-receiving hole. Then, the under surface of one side edge portion of a second top plate is placed on the other half of the upwardly facing surface of the second leg. Under the condition, the second leg is slid relative to the second top plate toward the user's side, whereupon engagement of the claws in the holes can be effected at half the claw-type engaging means, so that the two top plates are fixed to the common second leg. Under the condition, the opposing side edges of the two top plates closely contact each other on the upwardly facing surface of the leg, the arm of which is rigidly connected to at least one of the adjoined top plates, so that the top plate prevents the leg from being inclined or displaced forwardly or rearwardly. In this manner, one after another top plate are connected successively, with the side edges of each adjoining pair of top plates being fixed to a common leg until the whole upwardly facing surface of the last leg is fixed to the outer side edge portion of the last top plate in the same manner as in the case of the initial side edge portion of the first top plate, whereupon n top plates and n+1 legs have been assembled into a rigid desk.

In accordance with the invention, since two adjoining top plates can be fixed to a common leg, the number of legs required for assembly of a desk can be reduced with resulting reduction of the cost and the number of working steps required for assembly and improvement of usability due to broadening of the space under the desk. In addition, since the adjoining top plates are supported by a common single leg, the upper surfaces of the top plates become flush with each other automatically, thereby to make easier or unnecessary the otherwise troublesome operation of adjusters or the like.

The embodiment, in which the claw-receiving holes are provided in the upwardly facing surface of the leg in pairs, the claws in each pair being spaced at a predetermined pitch from each other widthwise of the top plate, and in which the claws are provided on the under surface of the top plate at a distance from each side edge thereof corresponding to half the above-mentioned pitch, operates in substantially the same manner, and with much the same advantages, as described above. In this embodiment, it is advantageous to provide on the under surface of the top plate additional claws spaced 3/2 of the above-mentioned pitch from the side edge of the top plate.

In addition to the basic construction described above, the desk of the invention may further comprise the following component to accommodate the cables of office machines which would otherwise extend over the desk.

In particular, in the desk of the invention a front panel may be provided in front of the front edge of the top plate to form between the front panel and the front edge of the top plate a cable-containing space or duct which can be opened and closed.

With this arrangement, the front panel can hide the tapered engaging means, and the cable-containing space or duct can contain cables or wires if necessary. This prevents the cables from being exposed to deteriorate the appearance of the desk or become obstructive, thereby to improve the usability of the desk or the space thereabout when office machines are used.

To make the cable-containing space or duct capable of being opened and closed, an upper lid may be provided between the front edge of the top plate and the upper edge of the front panel, so that the lid may continue from the top plate when closed, and make the cable-containing space open upwardly when opened.

To accommodate cables or wires effectively, it is preferable to attach to the inner side of the front panel a trough which forms the bottom wall of the cable-containing space. In order to accommodate cables effectively in a plurality of top plates consecutively connected side by side, it is preferable to provide between each lateral side of the front edge of the top plate and the corresponding side edge of the front panel a lateral lid which, when closed, makes a continuous surface with the outer lateral surface of the leg and, when opened, opens the cable-receiving space laterally.

In order to be rigid and good in appearance, the leg comprises a steel framework comprising a base adapted to be placed on the floor and a support arm connected to the base through a post and having an upwardly facing surface, and a cover assembly made of synthetic resin for covering the outer surface of the framework.

To make the framework of the leg simple in construction and sufficiently rigid, the arm may comprise an upwardly open inner channel member fitted in, and welded to, an upwardly open outer channel member to form a partially tubular member, and the base may comprise a downwardly open inner channel member fitted in, and welded to, a downwardly open outer channel member to form a partially tubular member. The cover assembly may comprise a front and a rear cover adapted to be attached to the support arm from below, a front and a rear cover adapted to be attached to the support base from above, and a pair of intermediate covers adapted to be attached to the post from both lateral sides after the front and rear covers have been mounted on the base and the arm.

BRIEF DESCRIPTION OF THE DRAWING

FIG. 1 is a perspective view of the whole of the desk.

FIG. 2 is a sectional plane view of the top plate without the paper core.

FIG. 3 is a sectional view taken along line III—III in FIG. 2.

FIG. 4 is a plane view of the leg.

FIG. 5 is a front view of the same.

FIG. 6 is an enlarged view of the tapered engaging means.

FIG. 7 is a partial plane view of the steel member formed with the tapered engaging means.

FIG. 8 is a front view of the same.

FIG. 9 is a left side view of FIG. 8.

FIG. 10 is a plane view of the arm formed with the convexly tapered surface.

FIG. 11 is a front view of the same.

FIG. 12 is a right side view of FIG. 11.

FIG. 13 is a sectional plane view of a part of the top plate showing the claw-type engaging means.

FIG. 14 is a sectional view taken along line XIV—XIV in FIG. 13.

FIGS. 15 and 16 are partial perspective views of the same embodiment used in different manners.

FIG. 17 is a sectional plane view of adjoining top plates of the same.

FIG. 20 is an exploded perspective view of the principal part thereof.

FIG. 21 is a sectional side view of the tapered engaging means.

FIG. 22 is a sectional side view of the claw-type engaging means.

FIG. 24 is an exploded sectional perspective view of the principal portion thereof.

FIG. 25 is a sectional side view of the tapered engaging means.

FIG. 26 is a sectional side view of the claw-type engaging means.

FIG. 27 is an exploded perspective view thereof.

FIG. 28 is a front view of the desk in assembled condition.

FIG. 29 is a plane view of the same.

FIG. 30 is a right side view of the same.

FIG. 31 is a rear view of the same.

FIG. 32 is a side view of the leg as viewed from inside.

FIG. 33 is a plane view of the top plate.

FIG. 34 is a sectional view taken along line A—A in FIG. 33.

FIG. 35 is a sectional view taken along line B—B in FIG. 33.

FIG. 36 is an enlarged view of the front edge portion of the top plate in FIG. 35.

FIG. 37 is an enlarged view of the portion of the same at the user's side.

FIG. 38 is a side view of the framework of the leg as viewed from outside.

FIG. 39 is a plane view of the same.

FIG. 40 is a left side view of the same.

FIG. 41 is a right side view of the same.

FIG. 42 is a view of the arm as viewed from the user's side.

FIG. 43 is a plane view of the same.

FIG. 44 is a right side view of the same.

FIG. 45 is a side view of the leg in covered condition as viewed from outside.

FIG. 46 is a plane view of the same.

FIG. 47 is a right side view of the same.

FIG. 48 is a left side view of the same.

FIG. 49 is an enlarged view, in vertical section, of a portion of the leg.

FIG. 50 is an enlarged view of a portion of the tapered engaging means.

FIG. 51 is a sectional view taken along line C—C in FIG. 50.

FIG. 52 is an enlarged sectional view of a portion of the claw-type engaging means.

FIG. 53 is a sectional view taken along line D—D in FIG. 52.

FIG. 54 is a view showing the front panel.

FIG. 55 is a plane view of the same.

FIG. 56 is a right side view of the same.

FIG. 57 is an enlarged side view of a portion of the leg as viewed from outside.

FIG. 58 is a plane view of the portion of the leg shown in FIG. 57.

FIG. 59 is a side view of the leg as viewed from inside.

FIG. 60 is a view of the inner plate.

FIG. 61 is a plane view of the same.

FIG. 62 is a right side view of the same.

BEST MODES FOR EMBODYING THE INVENTION

Several embodiments of the invention will be described below with reference to the drawings.

FIRST EMBODIMENT

Figure 2:
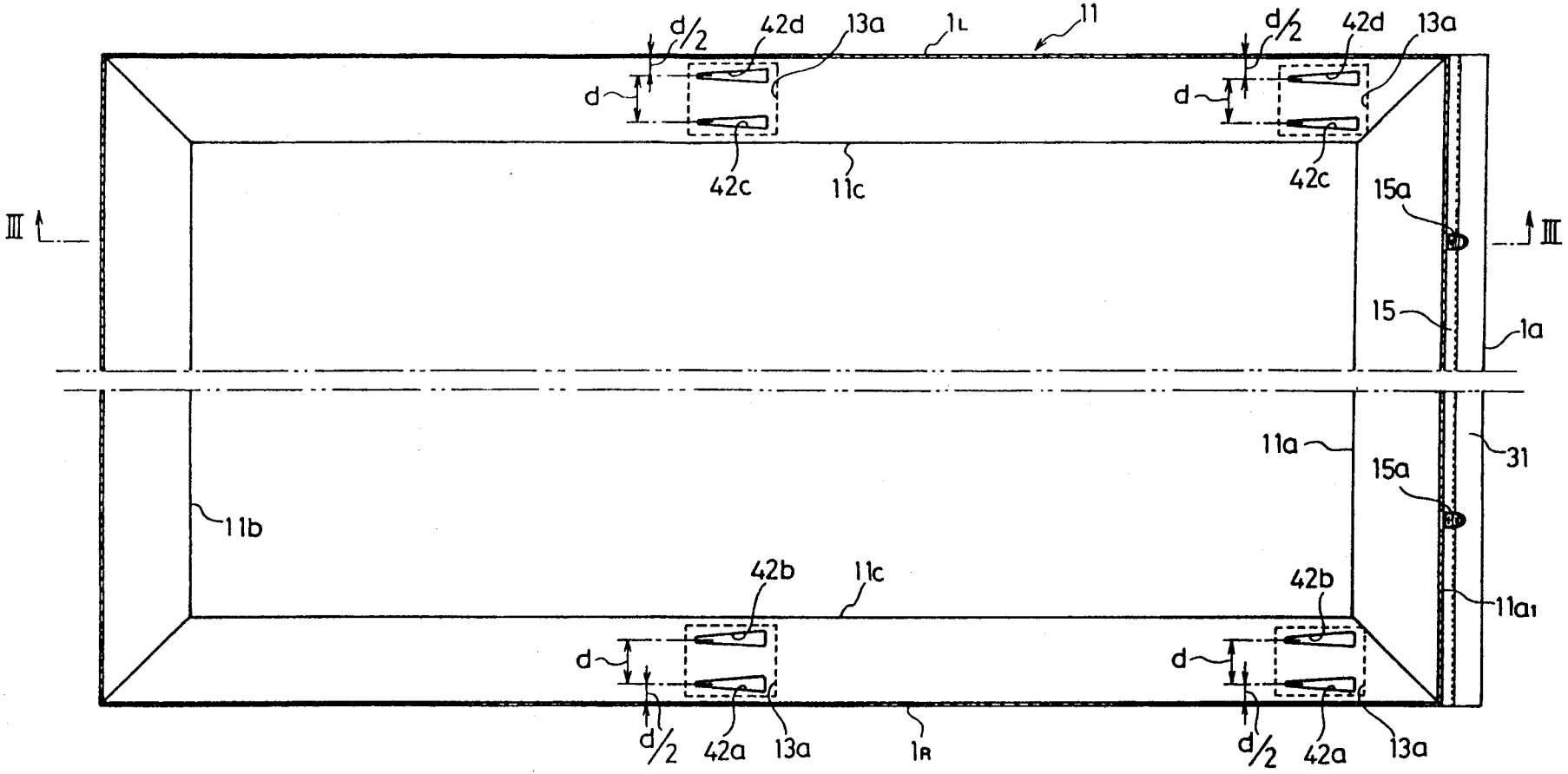
Figure 3:
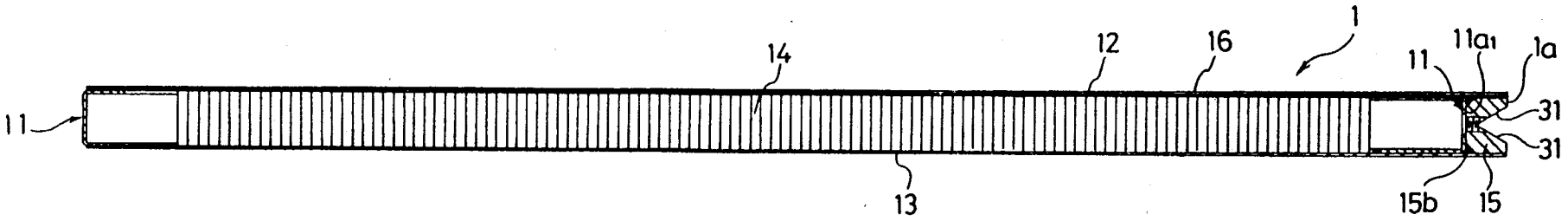

The desk shown in FIGS. 1 to 17 includes a top plate 1 comprising a frame 11 with a pair of steel plates 12 and 13 affixed to the upper and lower sides of the top plate. In particular, as shown in FIGS. 2 and 3, the frame 11 comprises a front channel-like frame member 11*a*, a rear channel-like frame member 11*b* at the user's side and a right and a left channel-like frame member 11*c* each arranged so as to be open inwardly and connected to form the frame, with a honeycombed paper core 14 enclosed therein. The pair of steel plates 12 and 13 are placed on the upper and lower surfaces of the frame 11, enclosing the paper core 14 with adhesive interposed therebetween and then pressed to fix the steel plates 12 and 13 onto the frame 11 and the paper core 14. A steel member 15 is welded at 15*b* to the front edge surface $11a_1$ of the front frame member 11*a* thereby to form a front edge 1*a* of the top plate 1. A melamine face 16 is attached to the upper surface of the upper steel plate 12.

Figure 1:
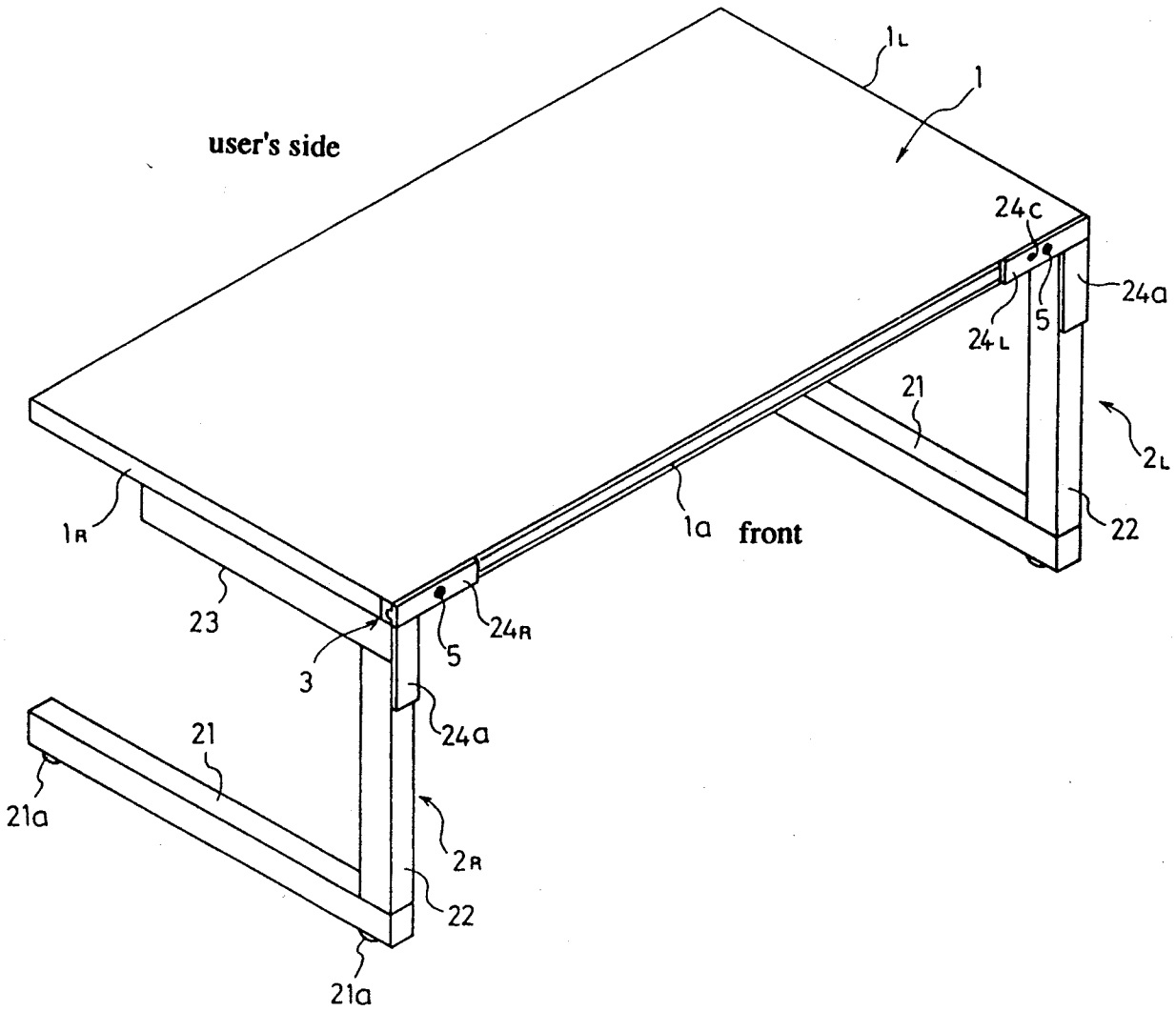
FIGS. 1 to 17 show one embodiment of the invention.
Figure 4:
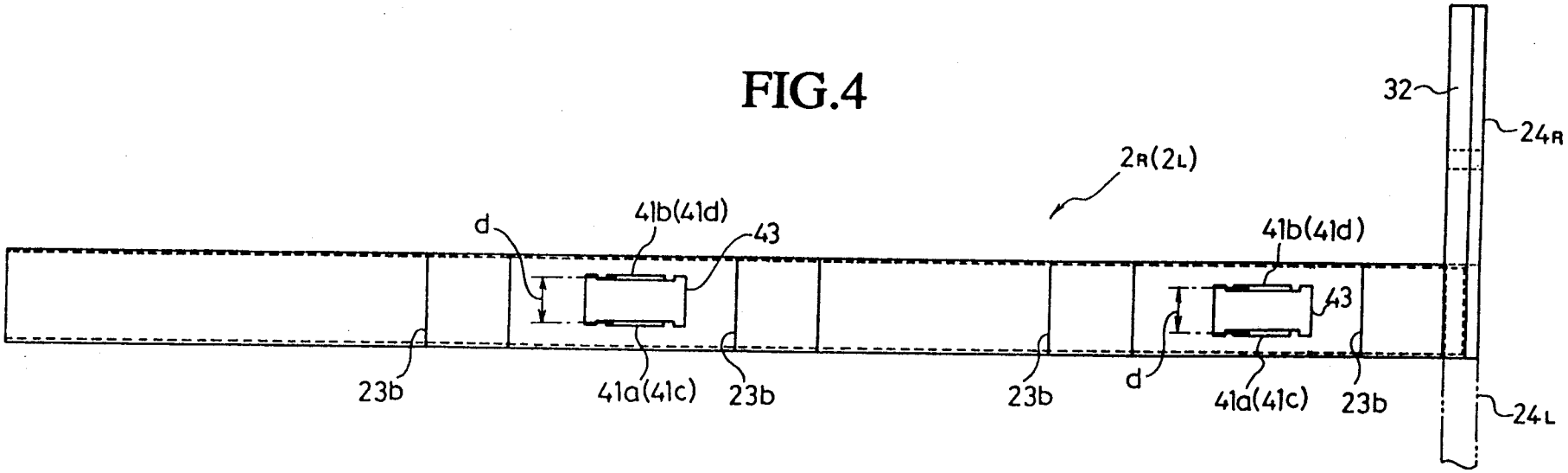
Figure 5:
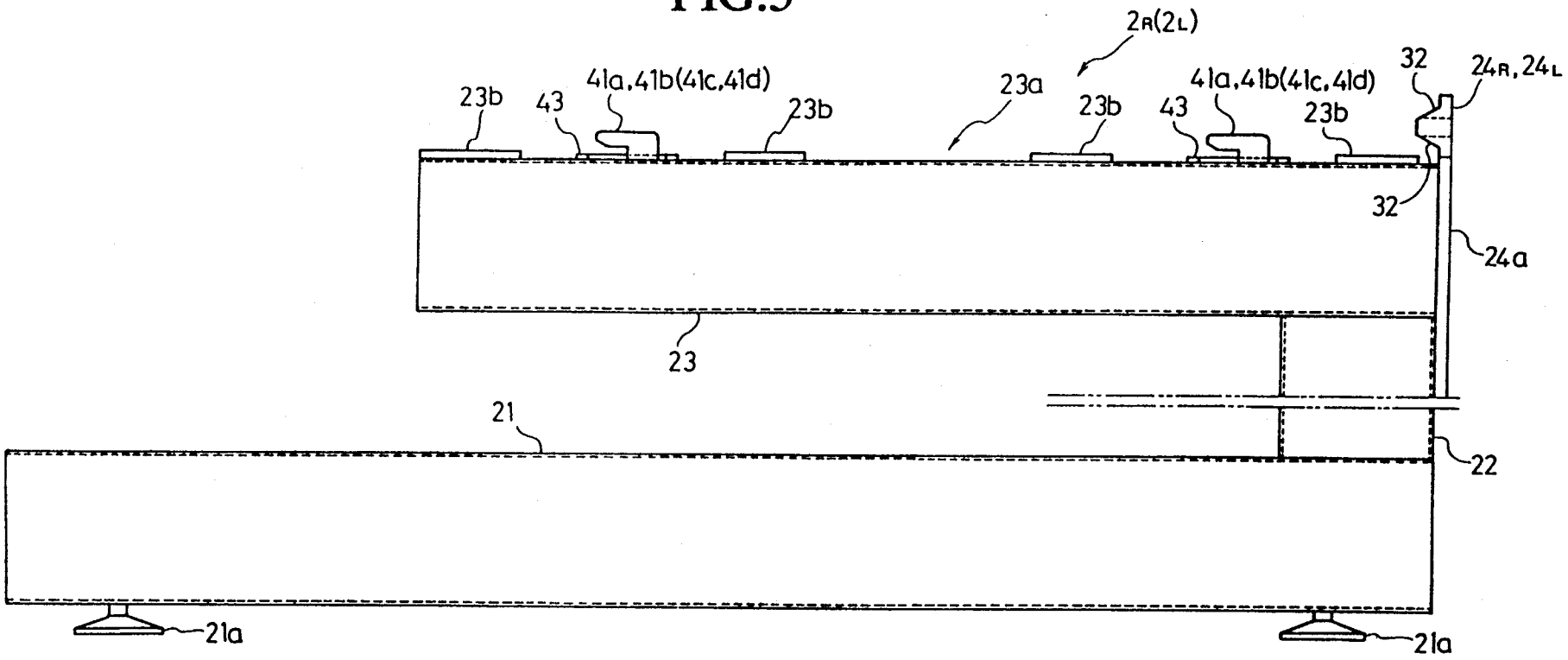
Figure 10:
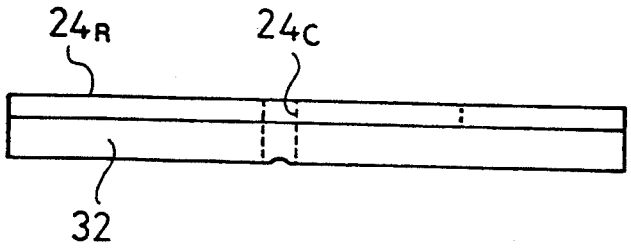
Figure 11:
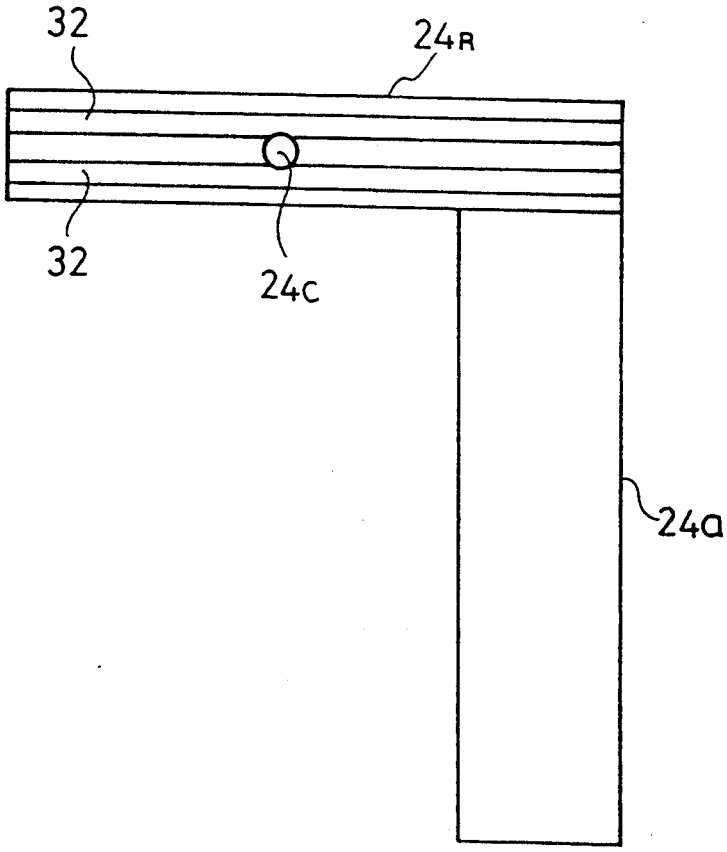
Figure 12:
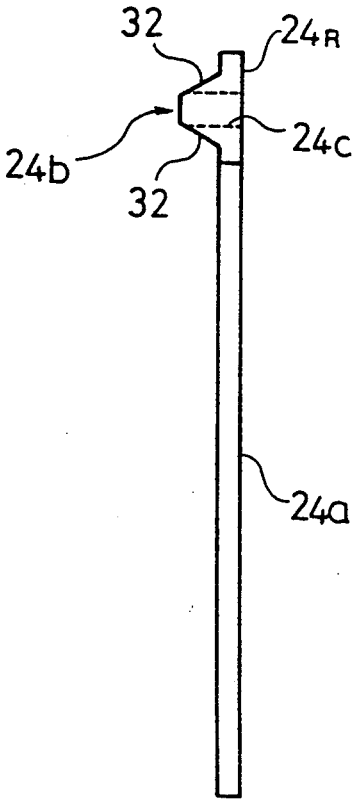

As shown in FIGS. 1, 4 and 5, the leg 2 comprises a base member 21 having a pair of adjusters 21*a*, a support post 22 standing upright on the base member 21, and a support arm 23 extending from the top end of the post 22 to the user'side. A plurality of spacers 23*b* are fixed on the upwardly facing surface 23*a* of the support arm 23, and the top plate 1 is placed on and supported by the spacers 23*b*, with its under surface in close contact with the spacers 23*a*. To the top end of the front portion of the leg 2 there is rigidly fixed an arm 24 extending along the front edge 1*a* of the top plate 1. In particular, as shown in FIGS. 10 to 12, the arm $24_R$ fixed to the leg 2R at the right side as viewed from the user's side is made of steel and provided at one end thereof with an integral mounting portion 24*a*, which is welded to the front surfaces of the previously mentioned support post 22 and the support arm 23, so that the arm $24_R$ extends horizontally to the left as viewed from the user's side. The arm 24L fixed to the leg 2L at the left side as viewed from the user's side is made of steel and provided at the end thereof symmetrical with the above-mentioned arm 24R with an integral mounting portion 24*a*, which is welded to the front end surfaces of the previously described support post 22 and the support arm 23, so that the arm $24_L$ extends horizontally to the right as viewed from the user's side.

Figure 6:
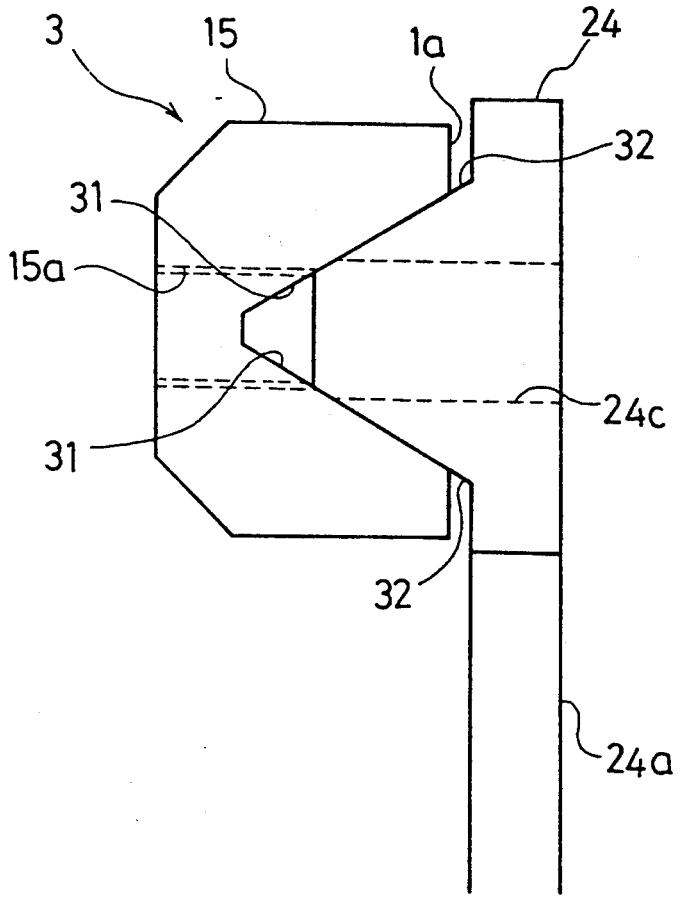
Figure 7:
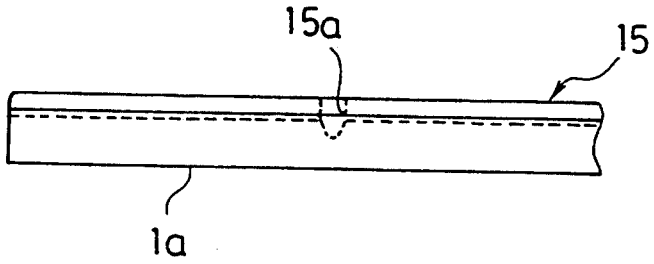
Figure 9:
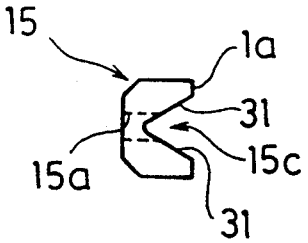
Figure 8:
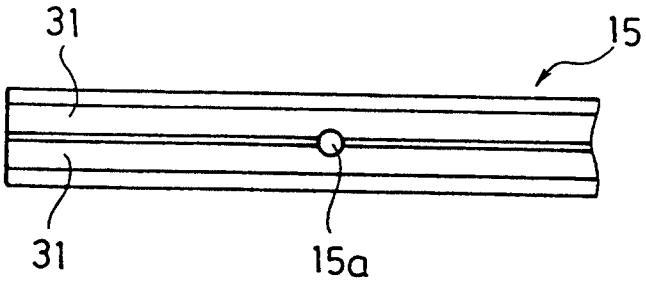

As shown in FIGS. 1 and 6, the tapered engaging means 3 comprises a concavely tapered surface 31 formed in the front edge 1*a* of the top plate 1, and a convexly tapered surface 32 formed on the arm 24 of the leg 2. In particular, as shown in FIGS. 7 to 9, the steel member 15 of the top plate 1 is formed with a V-shaped groove 15*c*, the inclined surfaces of which constitute the concavely tapered surface 31. As shown in FIGS. 10 to 12, the arm 24 is formed at the user's side thereof with a ridge 24*b* trapezoidal in transverse section, the inclined surfaces of which constitute the convexly tapered surface 31. Under the condition that the top plate 1 is placed on the leg 2, the two tapered surfaces 31 and 32 are set at the same level. Under the condition, as the leg 2 is moved relative to the top plate 1 toward the user's side, the tapered surfaces come into contact with each other.

As shown in FIGS. 2, 4, 5, 13 and 14, of which the latter two figures show in a single drawing the leg 2R connected to the right side edge portion 1R of the top plate as well as the leg 2L connected to the left side edge portion 1L thereof, the claw-type engaging means 4 comprises bent claws 41*a* and 41*b* (41*c* and 41*d*) formed on the upwardly facing surface 23*a* of the leg 2R (2L), and claw-receiving holes 42*a* to 42*d* formed in the under surface of the top plate 1. In particular, a piece of metal 43 is fixed to the upwardly facing surface 23*a* of the leg 2R (2L) at two locations, and a pair of projecting claws 41*a* and 41*b* (41*c* and 41*d*) are formed on each of the pieces of metal 43 and spaced a predetermined distance d from each other so as to extend toward the user's side. On the other hand, in the side component member 11*c* of the frame 11 there are formed claw-receiving holes 42*a* (42*d*) at a distance of d/2 from the side edge 1R (1L) of the top plate and claw-receiving holes 42*b* (42*c*) at a distance of 3d/2 from the side edge. Each of the holes is elongated to form a slot gradually tapering toward the user's side. The lower steel plate 13 is formed with openings 13*a* to expose the holes 42*a* to 42*d* in the under surface of the top plate 1, so that the claws 41*a* and 41*b* (41*c* and 41*d*) may be inserted through the holes 42*a* and 42*b* (42*c* and 42*d*) into the space inside the top plate 1, and by sliding the leg 2R (2L) relative to the top plate 1 toward the user's side the claws 41*a* and 41*b* (41*c* and 41*d*) may be brought into contact with the inner surface of the side frame member 11*c*. Sliding movement of the leg 2 relative to the top plate 1 causes engagement to occur simultaneously at both engaging means 3 and 4.

As shown in FIGS. 1, 6, 13 and 14, under the condition that both means 3 and 4 are engaged, a single bolt 5 is used as a fastener to fix the above-mentioned arms 24R and 24L to the front edge 1*a* of the top plate 1. To this end, the arm 24R is formed with a single hole 24*c* for a bolt to pass through, and the arm 24L is formed with a pair of holes 24 for a bolt to pass through spaced a distance d apart from each other. Usually, one of the two holes 24*c* in the arm 24L is not used. The steel member 15 of the top plate 1 is formed with threaded holes 15*a* at such positions as to register with the holes 24*c*. With both the tapered surfaces 31 and 32 having been brought into close contact with each other, a bolt 5 is inserted through each of the two holes 24*c* and screwed into the threaded hole 15*a* thereby to securely fix the arms 24R and 24L to the front edge 1*a* of the top plate 1.

The desk of the above construction can be assembled and disassembled quite easily. In particular, to fix first the leg 2R to the right side portion 1R of the top plate 1, the upwardly facing surface 23*a* of the leg 2R is brought into contact with the under surface of the top plate 1, and the leg 2R is slid relative to the top plate 1 toward the user's side, whereupon the claws 41*a* and 41*b* of the claw-type engaging means 4 engage the claw-receiving holes 42*a* and 42*b*, and at the same time the arm 24R on the leg 2R approaches the front edge 1*a* of the top plate 1 until the convexly tapered surface 32 of the tapered engaging means 3 contacts the concavely tapered surface 31 thereof. Under the condition, a bolt 5 is inserted through the bolt-passing hole 24*c* and fastened to the top plate 1, whereupon the convexly tapered surface 32 closely contacts the concavely tapered surface 31 thereby to fix the arm 24R to the top plate 1. Since the arm 24R is rigidly fixed to the leg 2R, when the arm 24R has been securely fixed to the top plate 1, the leg 2R becomes hard to be inclined relative to the top plate 1. Since the arm 24R is fixed to the front edge 1*a* of the top plate 1 thereby to prevent the leg 2R from being displaced forwardly or rearwardly, the claws 41*a* and 41*b* will not be disengaged from the holes 42*a* or 42*b*, so that the under surface of the top plate 1 and the upwardly facing surface 23*a* of the leg 2R will not be separated.

Figure 13:
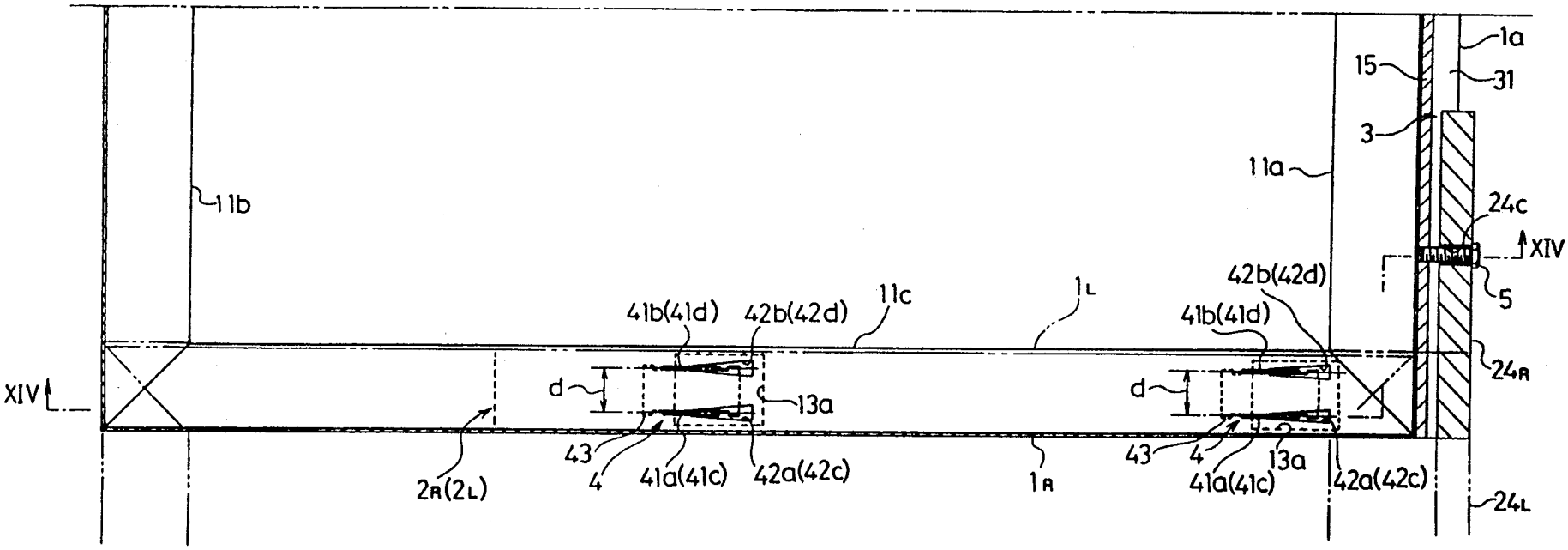
Figure 14:
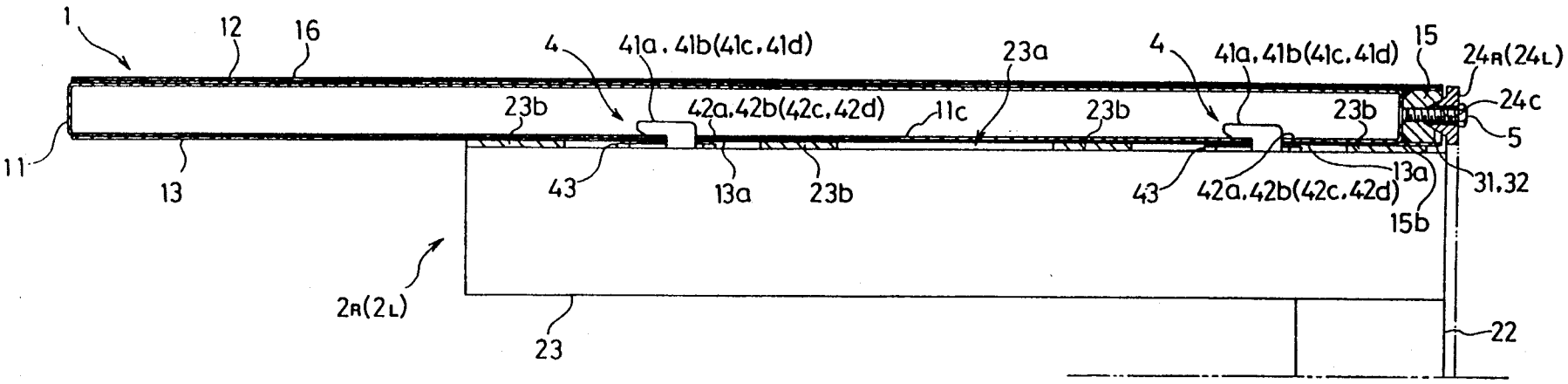

Next, the upwardly facing surface 23*a* of the left leg 2L is brought into contact with the under surface of the left side portion 1L of the top plate 1, and the leg 2L is slid relative to the top plate 1 toward the user's side, whereupon the claws 41*c* and 41*d* of the claw-type engaging means 4 engage the holes 42*c* and 42*d* thereof as shown in parentheses in FIG. 13, and at the same time the arm 24L on the leg 2L approaches the front edge 1*a* of the top plate 1 as far as the convexly tapered surface 32 of the tapered engaging means 3 contacts the concavely tapered surface 31 thereof. Under the condition, a bolt 5 is inserted through that one of the holes 24*c* which is normally used and fastened to the top plate 1, so that the leg 2L is rigidly fixed to the top plate 1. Thus, the single plate and the pair of legs 2R and 2L have been assembled to form a rigid desk.

As mentioned above, in this desk the top plate 1 is so constructed as to provide rigidity by itself, and with the top plate 1 as a basic component, the legs 2R and 2L are fixed to the top plate 1 by means of the tapered engaging means 3 and the claw-type engaging means 4 so as not to be inclinable or displaceable forwardly or rearwardly, so that two bolts 5 suffice to provide a sufficient degree of strength without the necessity of using many bolts to increase rigidity as in the prior art. As compared with known desks, the illustrated desk requires a reduced number of working steps for assembly or disassembly, and yet can serve as an excellent desk which is solid and firm and hardly becomes loose.

Figure 15:
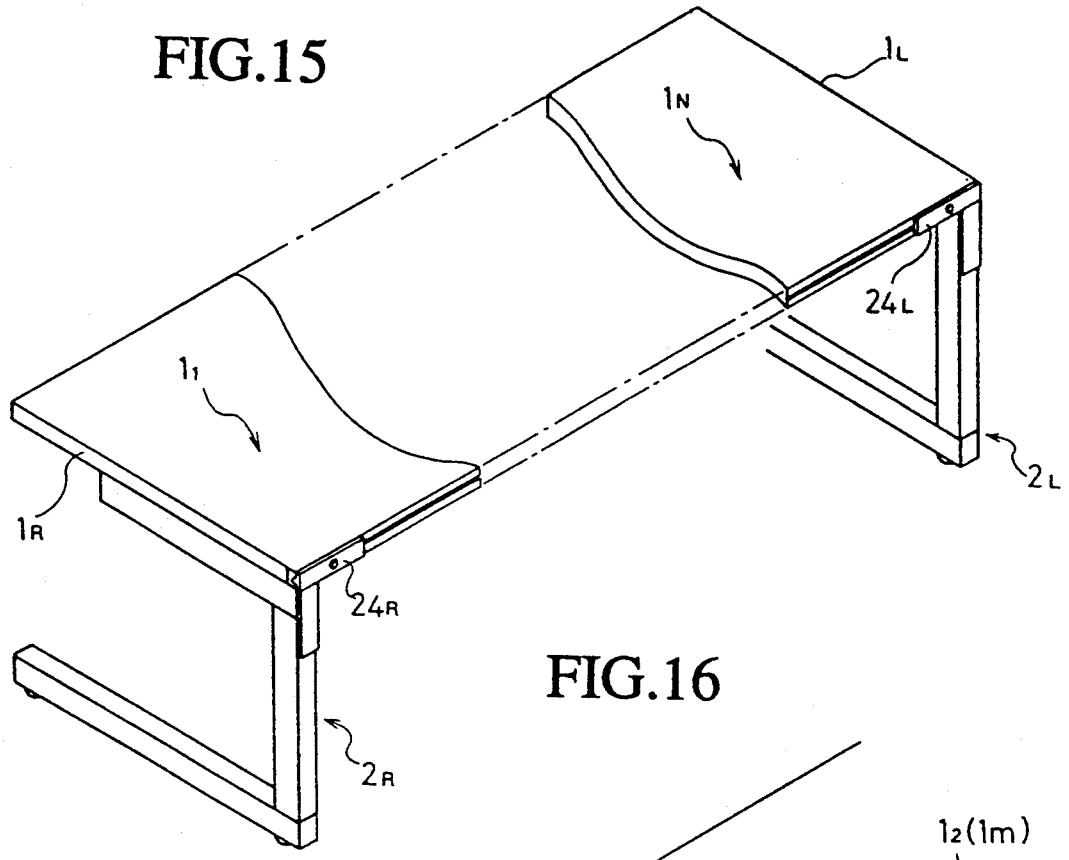
Figure 16:
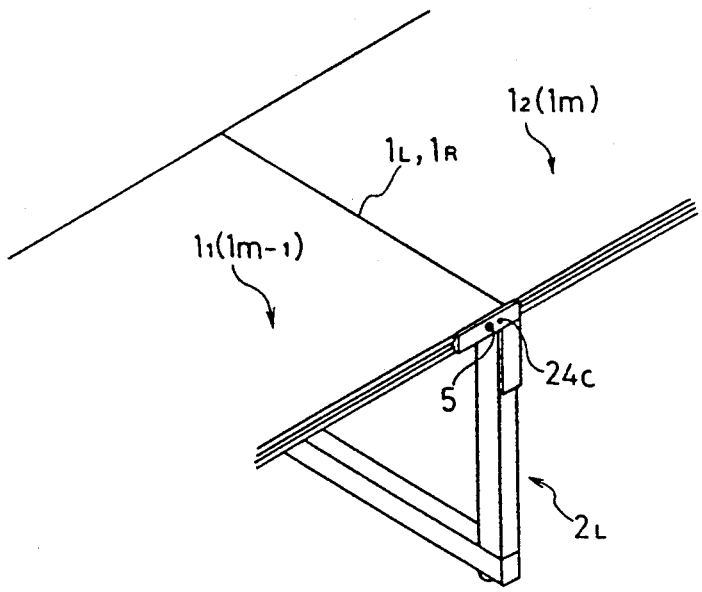
Figure 17:
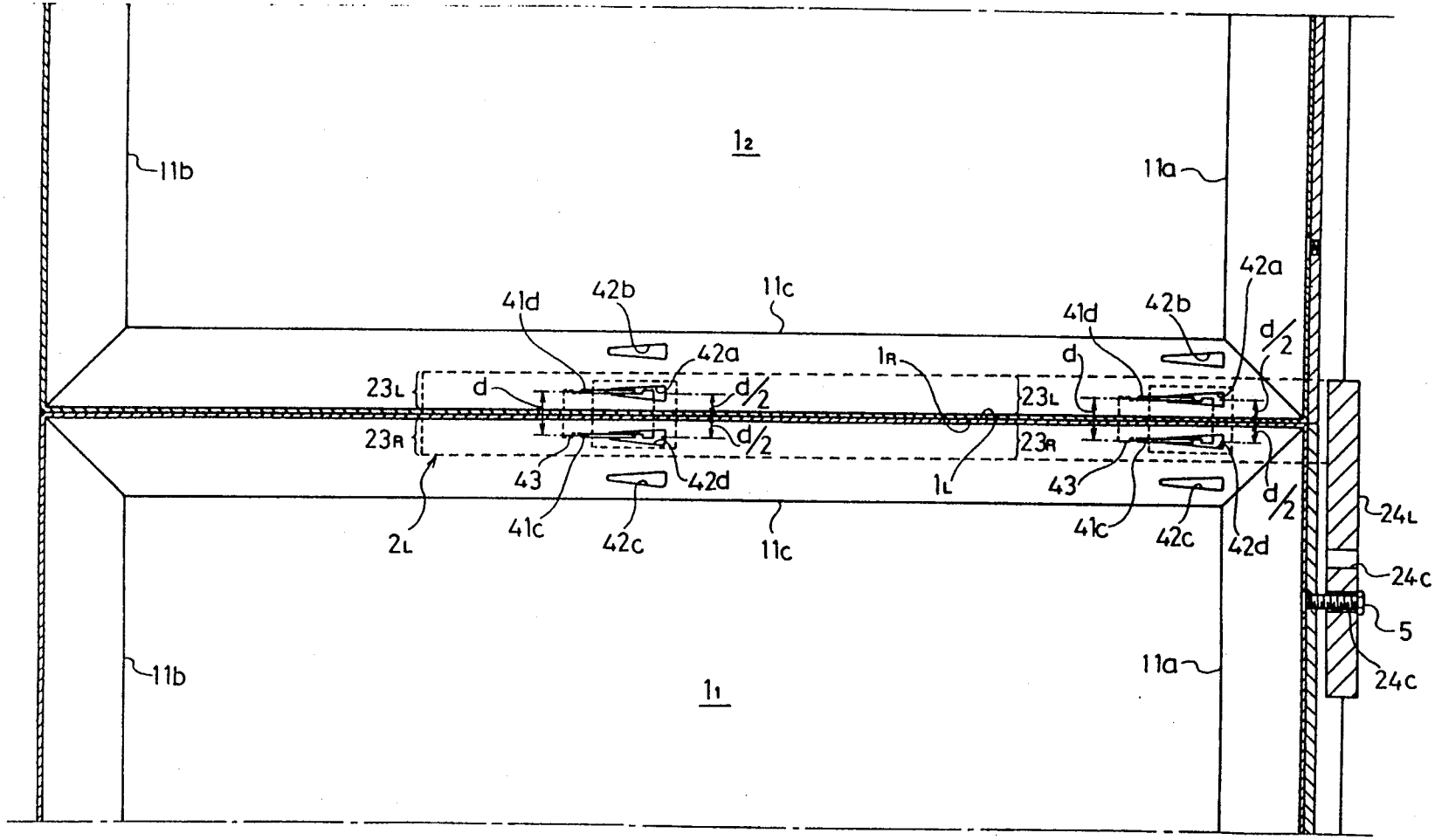

With the claw-type engaging means of the above-mentioned construction, it is easy to make a desk of a plurality of top plates connected as shown in FIG. 15. In particular, first a leg 2R is fixed to the right side edge portion 1R of a top plate $1_1$ in the same manner as previously described. Then, the right half 23R of the upwardly facing surface 23*a* of a leg 2L is applied to the under surface of the left side edge portion 1L of the top plate $1_1$ as shown in FIGS. 16 and 17. Under the condition the leg 2L is slid relative to the top plate $1_1$ toward the user's side, whereupon unlike in the previously described arrangement each claw 41*c* engages the claw-receiving hole 42*d* due to the previously described dimensional relation. Then, the under surface of the right side edge portion 1R of another top plate $1_2$ is brought into contact with the left half 23L of the upwardly facing surface 23*a* of the leg 2L. Under the condition the leg 2L is slid relative to the top plate $1_2$ toward the user's side, whereupon the other claws 41*d* engage the holes 42*a* of the second top plate $1_2$, so that each of the two top plates $1_1$ and $1_2$ is connected to one of the two halves of the common leg 2L. Under the condition the left side edge 1L of the top plate $1_1$ and the right side edge 1R of the top plate $1_2$ closely contact each other on the upwardly facing surface 23 of the leg 2L, and the arm 24L of the leg 2L is secured to the top plate $1_1$ by means of a bolt 5 inserted through that one of the bolt-passing holes 24*c* which is not usually used, so that inclination or displacement of the leg 2L is prevented. In like manner the left side edge portion 1L of a top plate $1_{m-1}$ and the right side edge portion of a succeeding top plate $1_m$ are connected by a succeeding leg 2L until the left side portion 1L of the last top plate $1_n$ is fixed to a leg 2L in the same manner as shown in FIG. 1, so that n top plates $1_1$ to $1_n$ and a single leg 2R and n legs 2L are formed into a firm, rigid desk.

As a result, about half as many legs 2 as were required in the prior art desks suffice, with resulting reduction of the cost and the number of working steps required for assembly. Since the leg 2 does not occupy a large space in the connected portions of adjoining top plates, the space about the user's feet is broadened to improve utility. In addition, since both the adjoining top plates $1_{m-1}$ and $1_m$ are set on the upwardly facing surface 23*a* of the common leg 2L, the upper surfaces of the top plates become flush with each other automatically without adjusting their heights, with resulting improvement of the appearance and usability of the desk as a whole.

Figure 18:
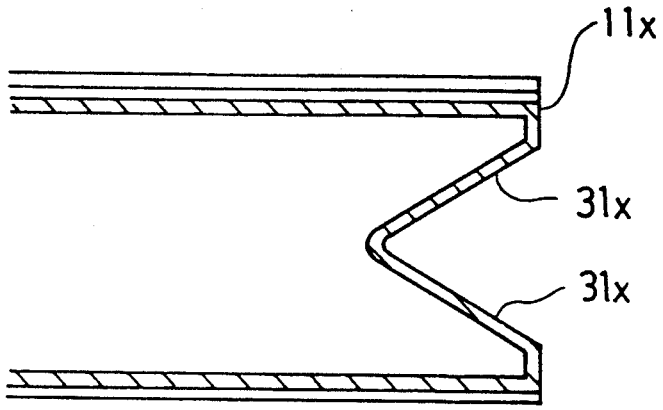
FIG. 18 is a view of a modified form of the frame in the above-mentioned first embodiment.
Figure 19:
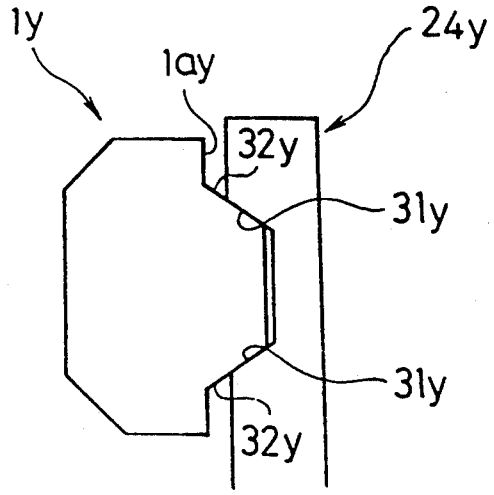
FIG. 19 is a view showing a modified form of the tapered engaging means.

In the above embodiment, the steel member 15 is welded at 15*b* to the front edge 1*a* of the top plate 1 and the concavely tapered surface 31 is formed in the steel member 15. As shown in FIG. 18, a concavely tapered surface 31*x* may be formed integrally in the frame 11*x*. As shown in FIG. 19, the tapered engaging means may also comprise a convexly tapered surface 32Y formed on a ridge provided on the front edge $1a_y$ of the top plate 1Y and a concavely tapered surface 31Y formed in a groove formed in the arm 24Y. Also, the claw-type engaging means may comprise a plurality of pairs of claw-receiving holes formed in the upwardly facing surface of the leg, each pair spaced apart from the other and the two holes in each pair spaced apart a predetermined pitch from the other widthwise of the top plate, and claws provided on the under surface of the top plate spaced half the pitch from the side edge thereof. With this arrangement it is possible to obtain the same operation and effects as in the above-mentioned embodiment. This claw-type engaging means may further comprise additional claws formed on the under surface of the top plate and spaced 3/2 of the pitch from the side edge thereof.

SECOND EMBODIMENT

Figure 20:
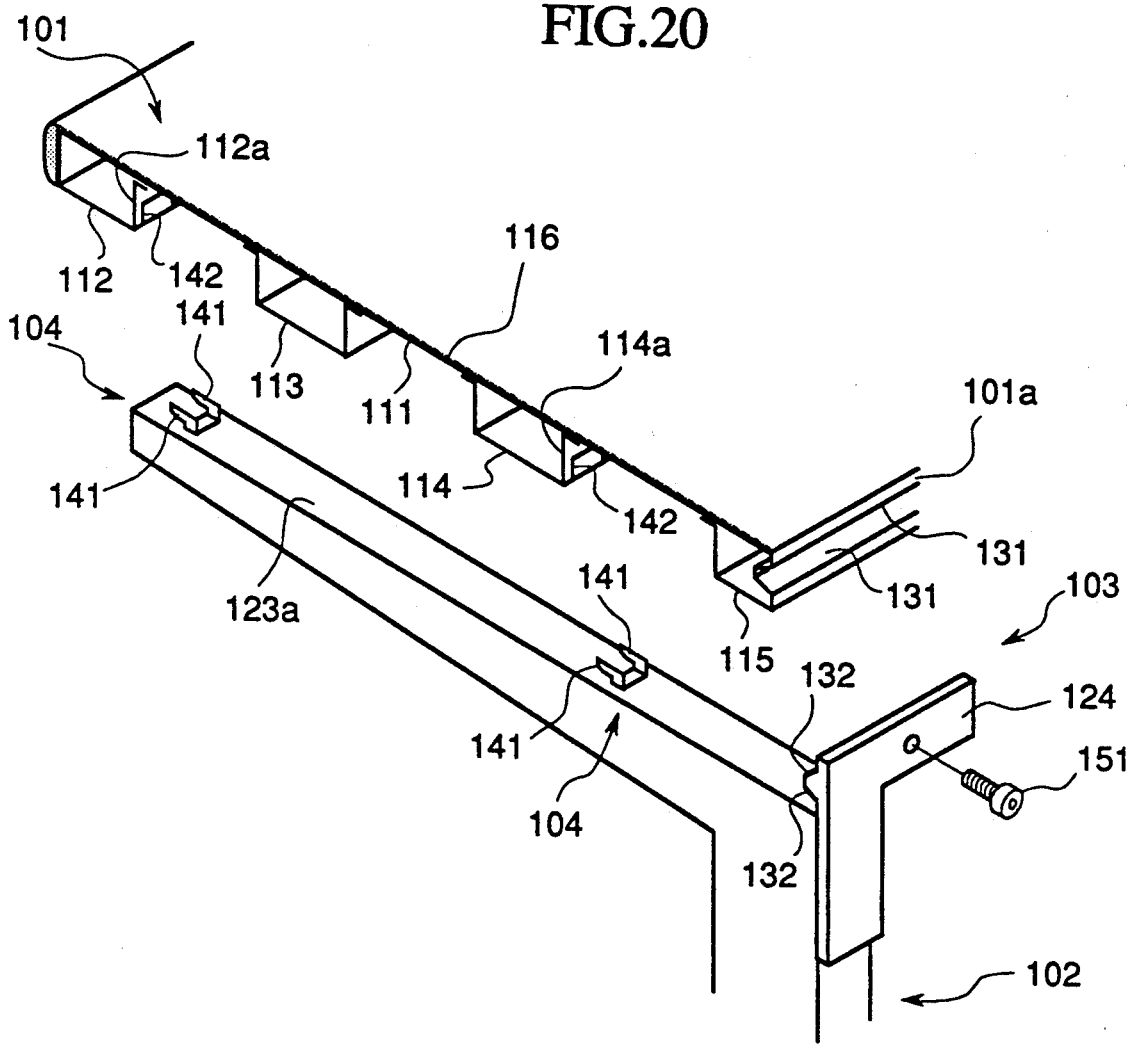
FIGS. 20 through 22 are views showing a second embodiment of the invention.
Figure 22:
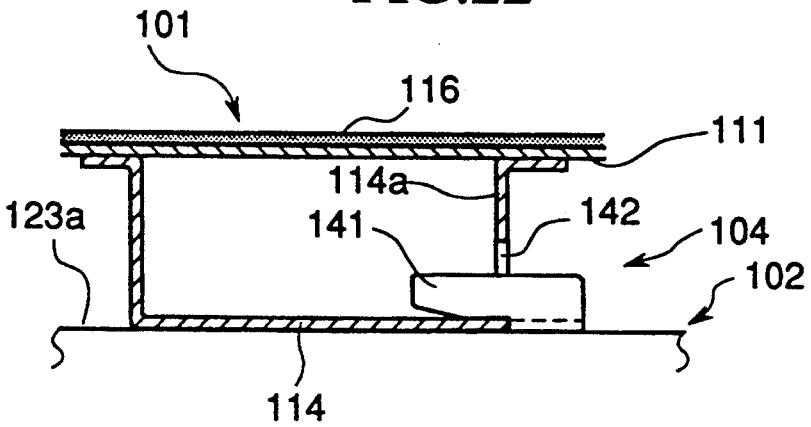

The desk shown in FIGS. 20 and 22 is of a different construction from the above-mentioned embodiment. The top plate 101 comprises a steel plate 111 reinforced on its under side by a plurality of reinforcing cross members 112, 113, 114 and 115 and faced with an upper plate 116. The top plate 101 is connected to a leg 102 by means of a tapered engaging means 103 and a claw-type engaging means 104.

Figure 21:
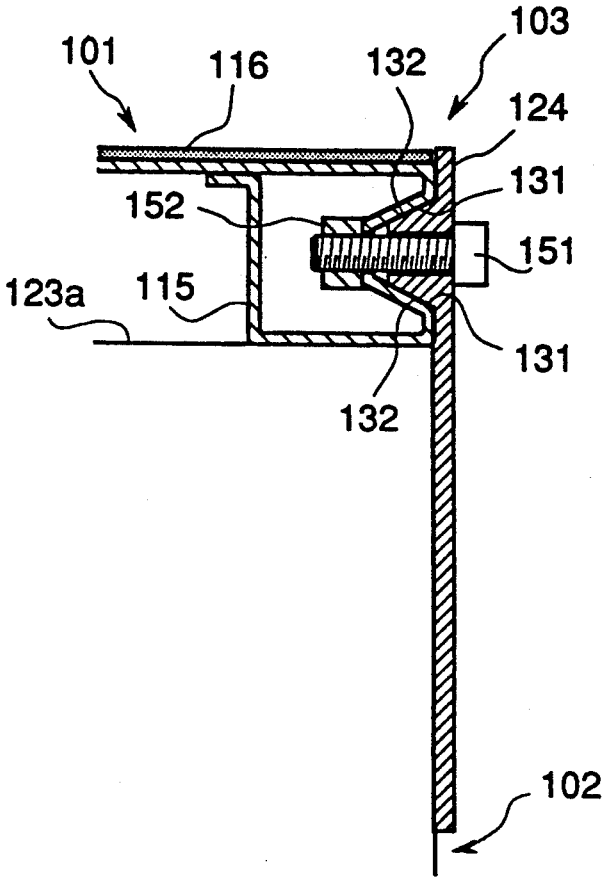

The tapered engaging means 103 comprises a concavely tapered surface 131 formed in the front side surface 10*a* of the top plate 101 and a convexly tapered surface 132 formed on the arm 124 of the leg 102. In particular, as shown in FIG. 21, the reinforcing cross member 115 of the top plate 101 has its front surface formed with a groove V-shaped in transverse section, the inclined surface of which constitutes the concavely tapered surface 131. The arm 124 is formed on the surface thereof at the user's side with a ridge trapezoidal in transverse section, the inclined surface of which constitutes the convexly tapered surface 132.

As shown in FIGS. 20 and 22, the claw-type engaging means 104 comprises bent claws 141 formed on the upwardly facing surface 123*a* of the leg 102, and claw-receiving holes 142 formed in the top plate 101. In particular, on the upwardly facing surface 123*a* of the leg 102 there are fixed by welding a front and a rear pair of claws 141 having their respective outer portions bent to extend toward the user's side. On the other hand, the claw-receiving holes 142 are rectangular and formed in the vertical front walls 112*a* and 114*a* of the reinforcing cross members 112 and 114 so that the outer end portions of each paired claws 141 may be inserted into one of the holes 142 simultaneously. In order to effect a tight engagement of the claws 141 in the holes 142, each paired claws, 141 are arranged slightly aslant to approach each other toward the outer ends thereof, so that as the claws are inserted deeper into each hole 142, the outer side surfaces of the paired claws 104 engage both side edges of the hole 142 more and more tightly.

Sliding movement of the leg 102 relative to the top plate 101 causes engagement to occur simultaneously at both engaging means 103 and 104. Under the condition a single bolt 151 inserted through the arm 124 is screwed into a fixed nut 152 provided inside the reinforcing cross member 115 thereby to effect a secure connection of the leg 102 to the top plate 101.

The desk of the above-mentioned construction with the top plate 101 properly reinforced by the reinforcing cross members 112 to 115 to provide a high degree of rigidity can be assembled or disassembled quite easily while retaining the rigidity of the whole structure. Since the steel plate 111 is reinforced on its under surface by the hollow reinforcing cross members 112 to 115, the top plate 101 is suitable for mass production from a steel plate by an established method. This leads to an advantage that the top plate 101 can be efficiently made by using an existing equipment such as a press and a welder.

Figure 23:
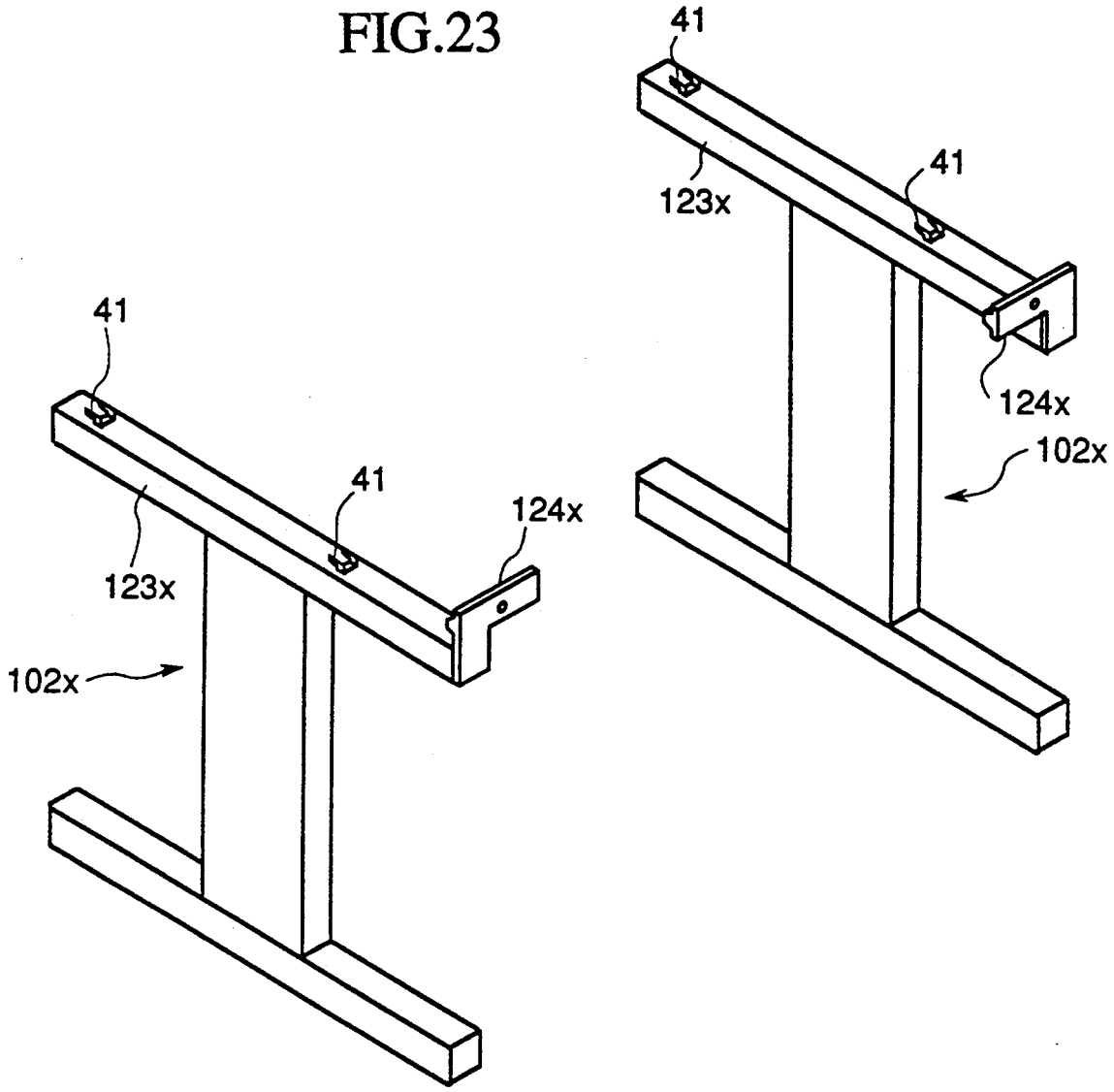
FIG. 23 is a perspective view of a modified form of the leg in the second embodiment.

The holes of the claw-type engaging means may be formed in the bottom walls of the reinforcing cross members. The leg is not limited to the one shaped like the letter of U lying on its one side as viewed laterally, but a leg shaped like H as viewed laterally as shown in FIG. 23. In this case an arm 124x is rigidly fixed to the front end of the support arm 123x.

THIRD EMBODIMENT

Figure 24:
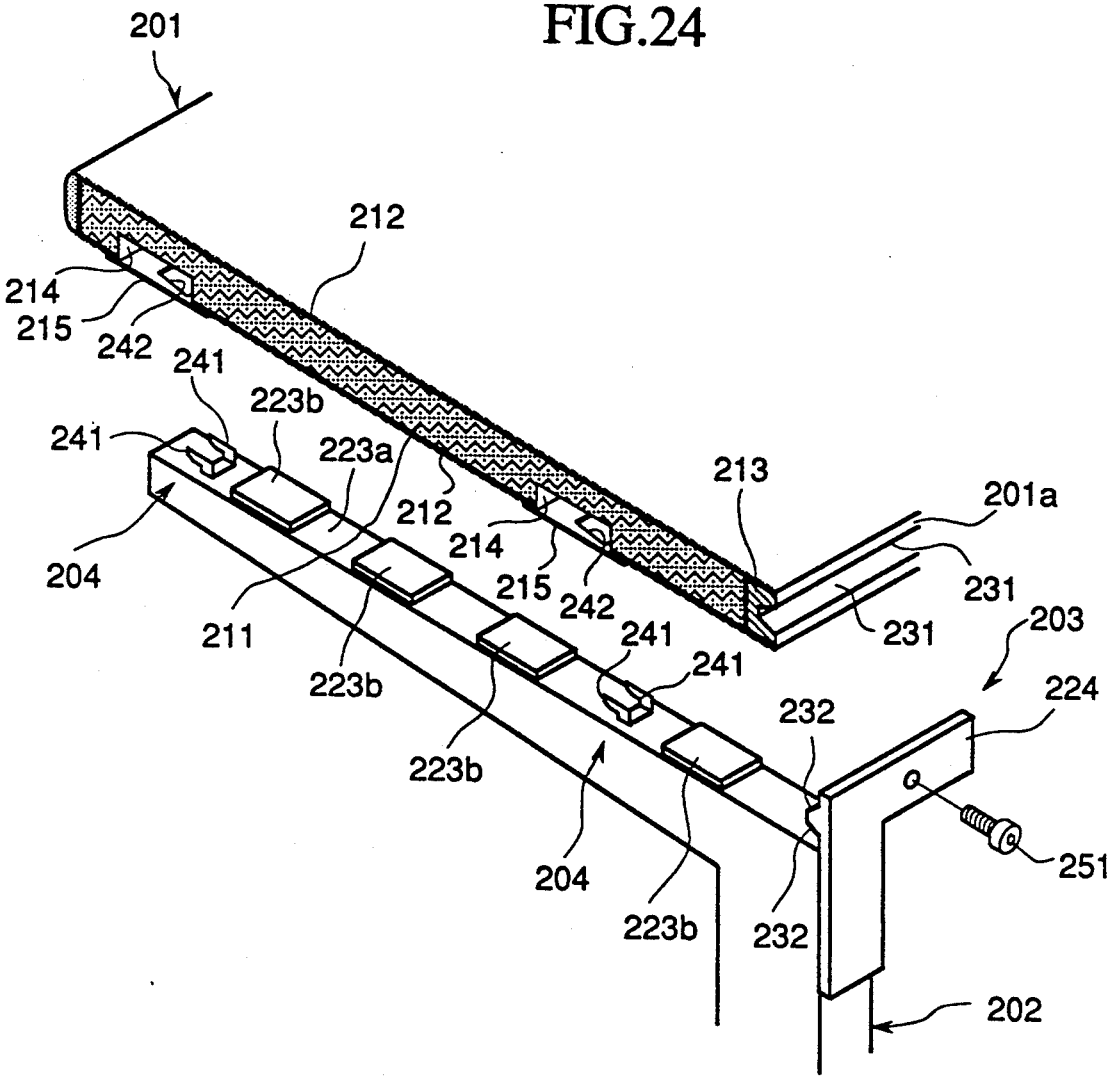
FIGS. 24 to 26 show a third embodiment of the invention.
Figure 25:
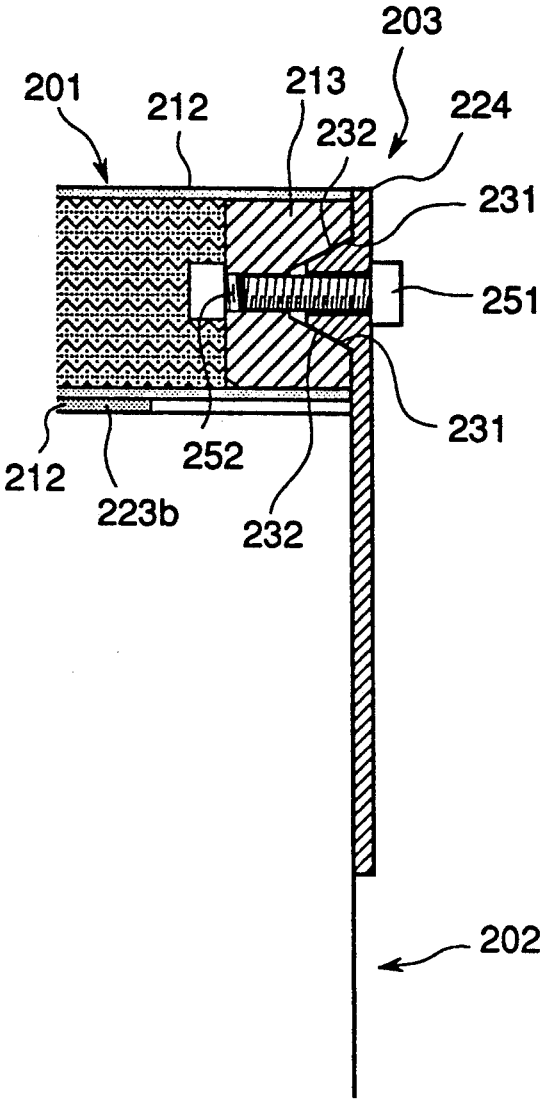
Figure 26:
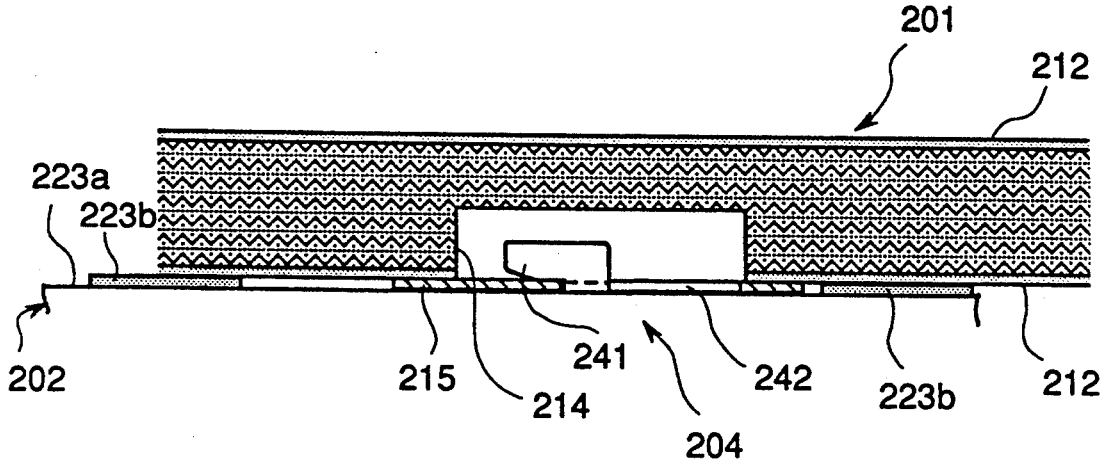

The desk shown in FIGS. 24 to 26 includes a top plate of a construction different from those of the above two embodiments. Here the top plate 201 comprises a solid wooden core member 211 faced with a decorative plate 212 on each side of the core member and a metal edge member 213 fixed to the front edge 201a thereof. The top plate 201 and a leg 202 are connected by a tapered engaging means 203 and a claw-type engaging means 204.

The tapered engaging means 203 comprises a concavely tapered surface 231 formed in the edge member 213 of the top plate 201 and a convexly tapered surface 232 formed on the arm 224 of the leg 202. In particular, as shown in FIG. 25, the edge member 213 of the top plate 201 is formed with a V-shaped groove, the inclined surface of which constitutes the concavely tapered surface 231. The arm 224 is formed at the user's side thereof with a ridge trapezoidal in transverse section, the inclined surface of which constitutes the convexly tapered surface 232.

As shown in FIGS. 24 and 26, the claw-type engaging means comprises bent claws 241 formed on the upwardly facing surface 223a of the leg 202 and claw-receiving holes 242 formed in the top plate 201. In particular, a pair of claws 241 are fixed by welding to the upwardly facing surface 223a of the leg 202 at two locations, and so bent that the outer end portions of the claws extend toward the user's side. On the other hand, the holes 242 are formed in a metal plate 215 fixed to the under surface of the top plate 201. In particular, the top plate 201 is formed at each of the positions corresponding to the above-mentioned claws 241 with a recess 214, with the above-mentioned metal plate 215 being fixed to the under surface of the top plate 201 to cover and close the recesses 214. The claw-receiving holes 242 are formed in the metal plate 215 at the positions corresponding to the above-mentioned recesses 214. Each of the holes 242 is trapezoidal in top plan view, with its width gradually decreasing toward the user's side, so that the paired claws 241 may engage the holes 242 to effect a tight connection therebetween. Spacers 223b are provided on the upwardly facing surface 223a of the leg 202.

Sliding movement of the leg 202 relative to the top plate 201 causes connection to occur simultaneously at both engaging means 203 and 204. Under the condition a single bolt 251 is screwed into a threaded hole 252 formed in the edge member 213 thereby to effect a secure connection between the leg 202 and the top plate 201.

The desk of the construction as described above has an advantage that it can be assembled and disassembled quite easily because the top plate 201 is wooden and provides a proper degree of rigidity.

FOURTH EMBODIMENT

The desk shown in FIGS. 27 to 62 comprises a top plate 301, a pair of legs 302, a tapered engaging means 303, a claw-type engaging means 304 and a front panel 305.

Figure 36:
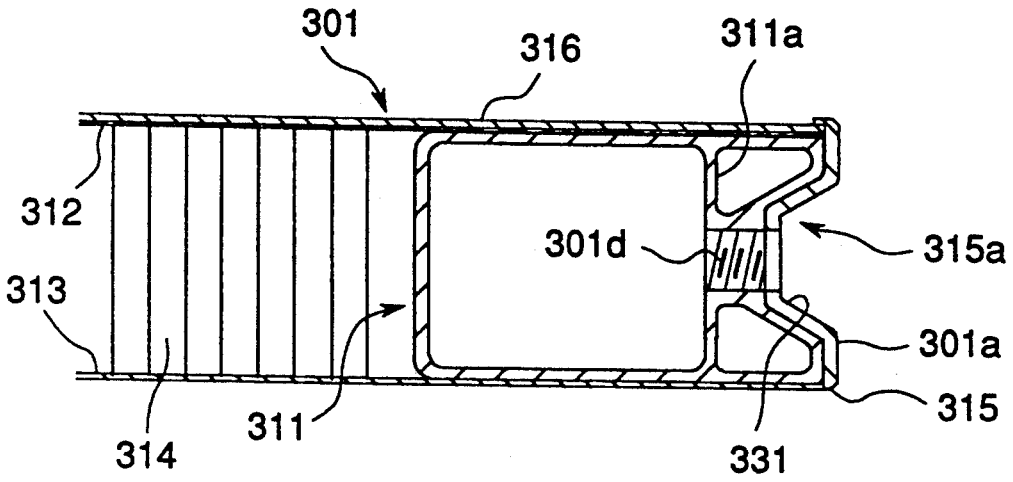
Figure 37:
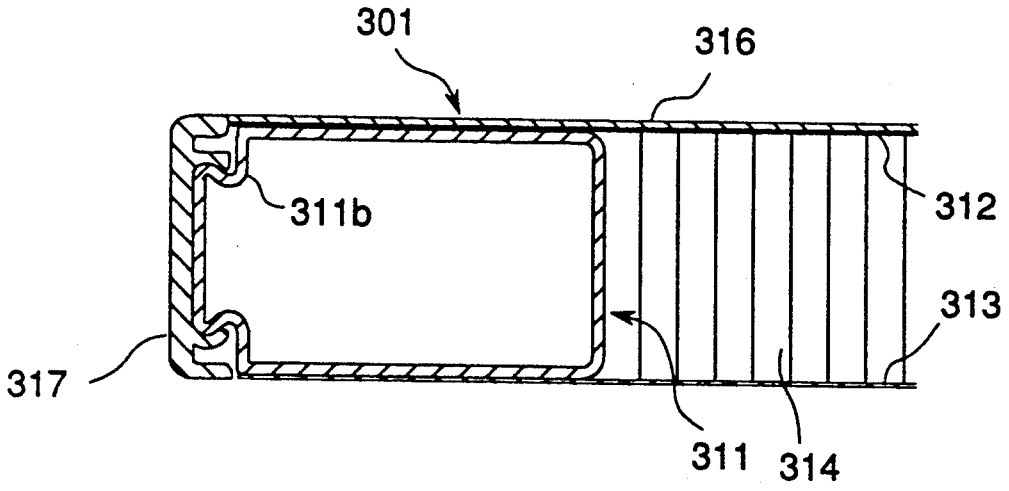

As shown in FIGS. 33 to 37, the top plate 301 comprises a frame 311 sandwiched between upper and lower metal plates 312 and 313. In particular, the frame 311 comprises a combination of a partially tubular front frame member 311a, a frame member 311b at the user's side, left and right side frame members 311c, with a honeycombed paper core 314 inside the frame members. A pair of steel plates 312 and 313 are applied to the upper and under surfaces of the frame 311 and the paper core 314 with adhesive interposed therebetween and then pressed to combine the frame 311, the steel plates 312 and 313 and the paper core 314. A front edge member 315 made of a hard vinylchloride steel plate and formed in the outer surface thereof with a trapezoidal groove 315a as shown in FIG. 36 is fixed to the front side of the front frame member 311a. The outer surface of the front edge member 315 constitutes the front edge 301a of the top plate 301. Also, as shown in FIG. 37, a rear edge member 317 made of a hard vinylchloride steel plate is fixed to that side of the frame member 311b which is at the user's side, and an edge member made of a soft vinylchloride steel plate, not shown, covers the user's side of the rear edge member 317. The previously described side frame members 311c are of the same shape as the frame member 311b at the user's side, and a side edge member 318 made of a hard vinylchloride steel plate is fixed to the outer side surface of each of the side frame members 311c. The upper surface of the upper steel plate 312 on the top plate 301 is faced with a decorative melamine plate 316.

Figure 27:
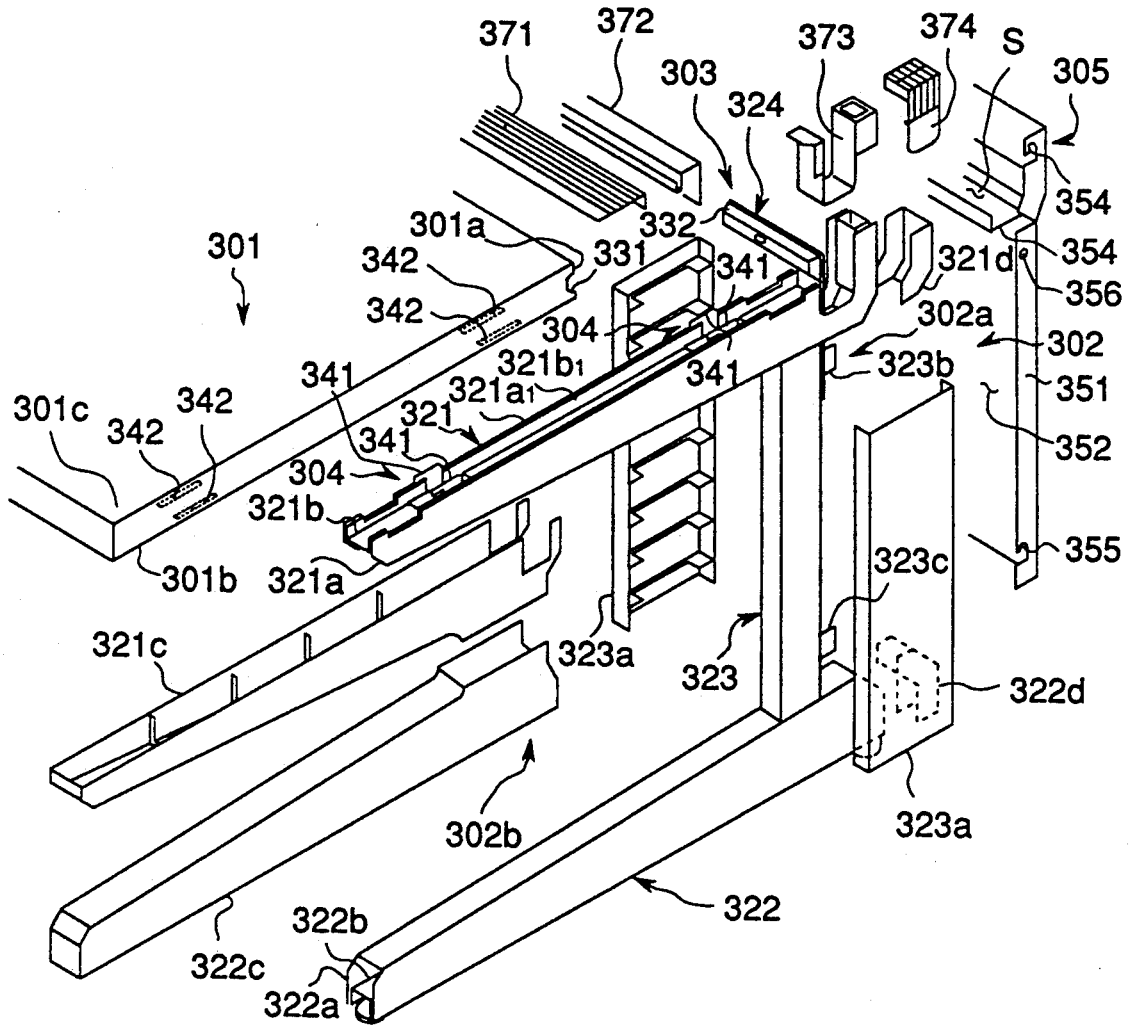
FIGS. 27 to 62 show a fourth embodiment of the invention.
Figure 28:
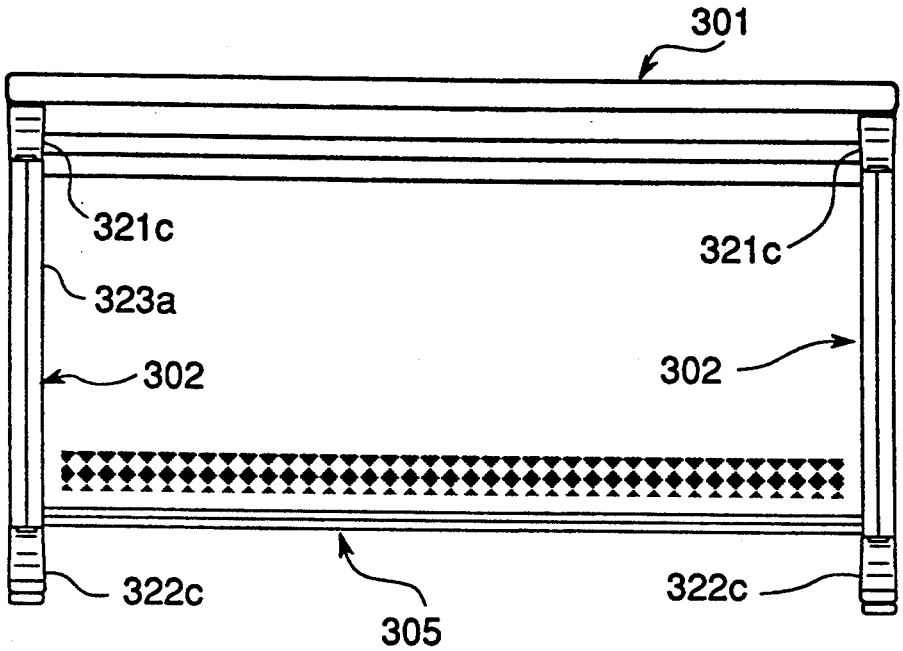
Figure 29:
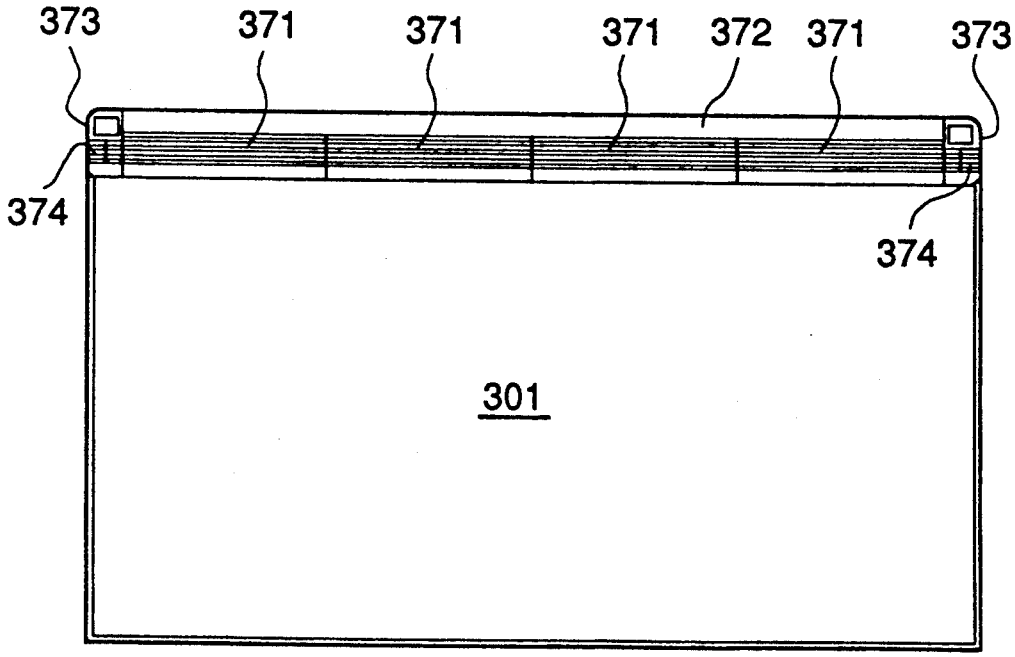
Figure 30:
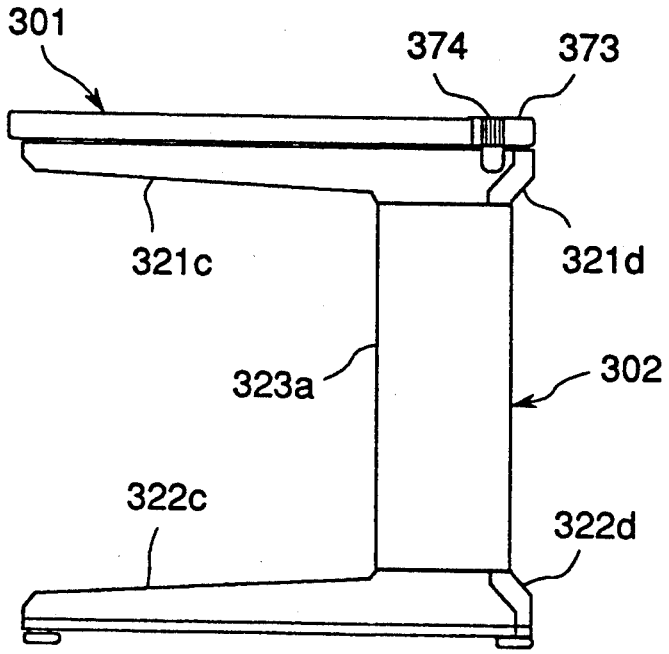
Figure 31:
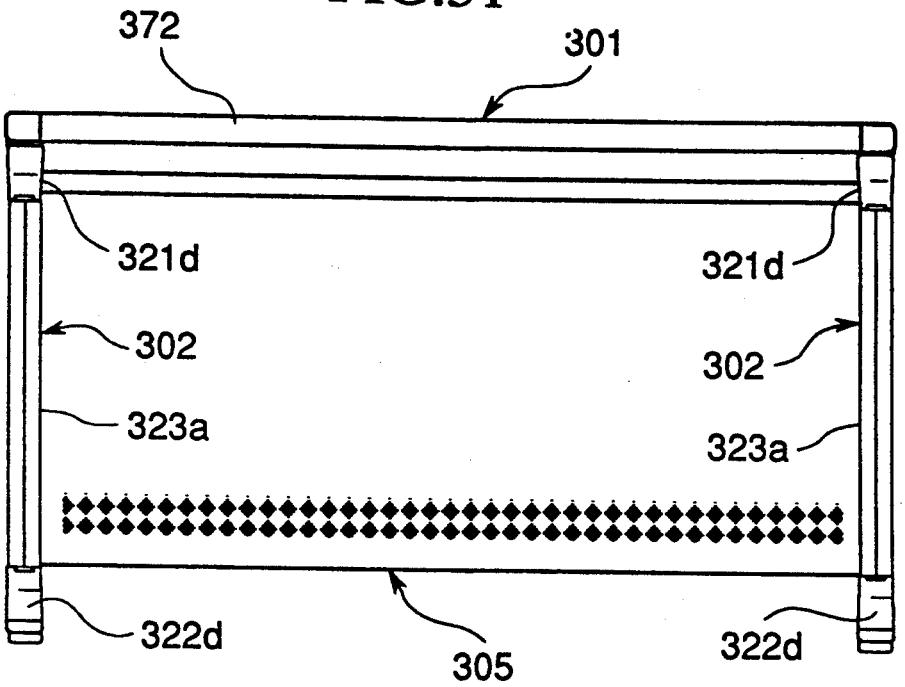
Figure 32:
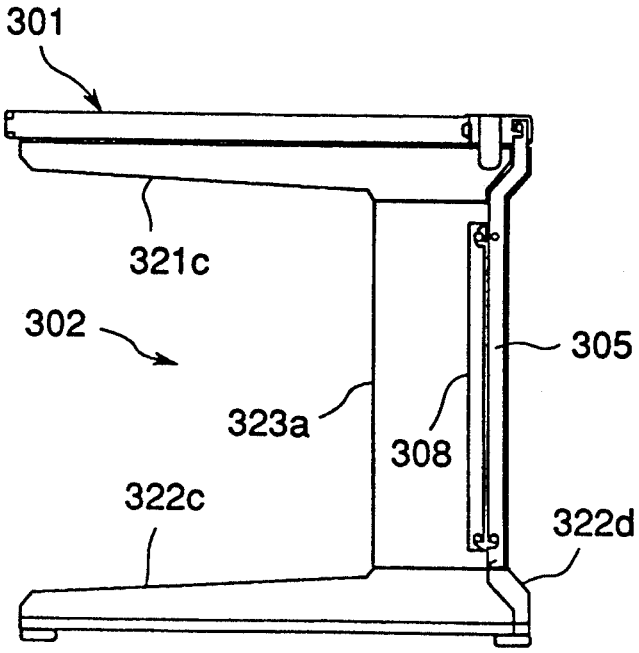
Figure 35:
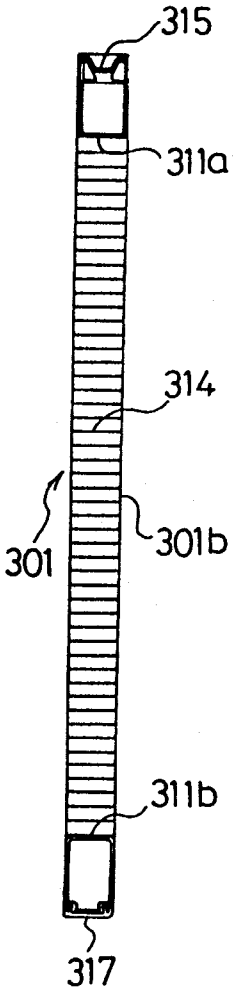
Figure 33:
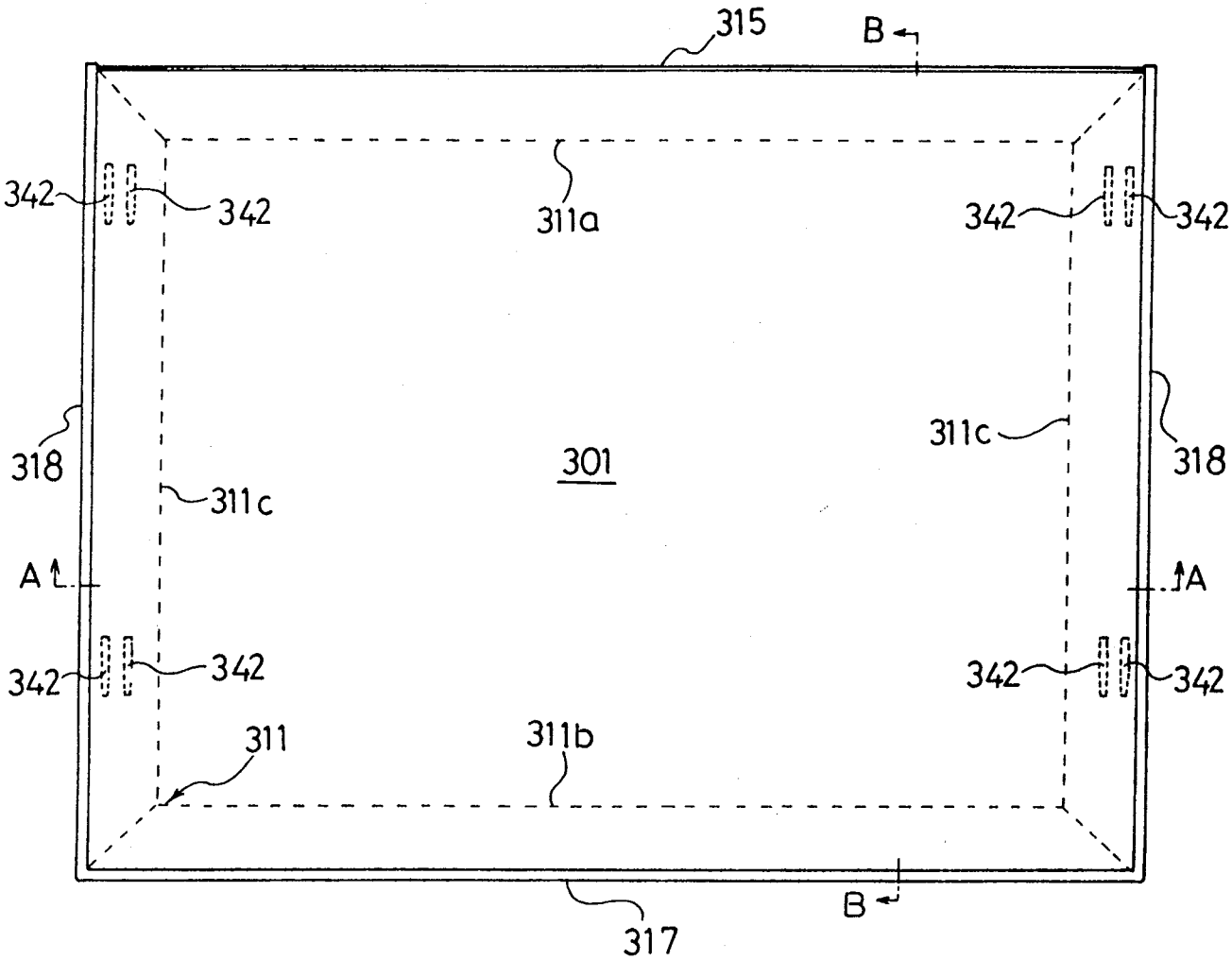
Figure 34:
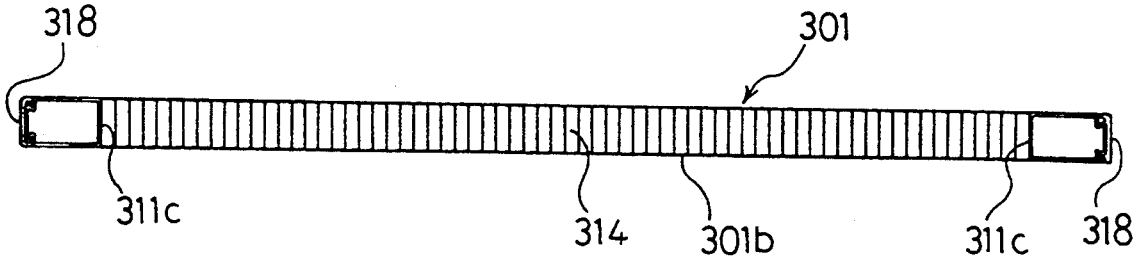
Figure 42:
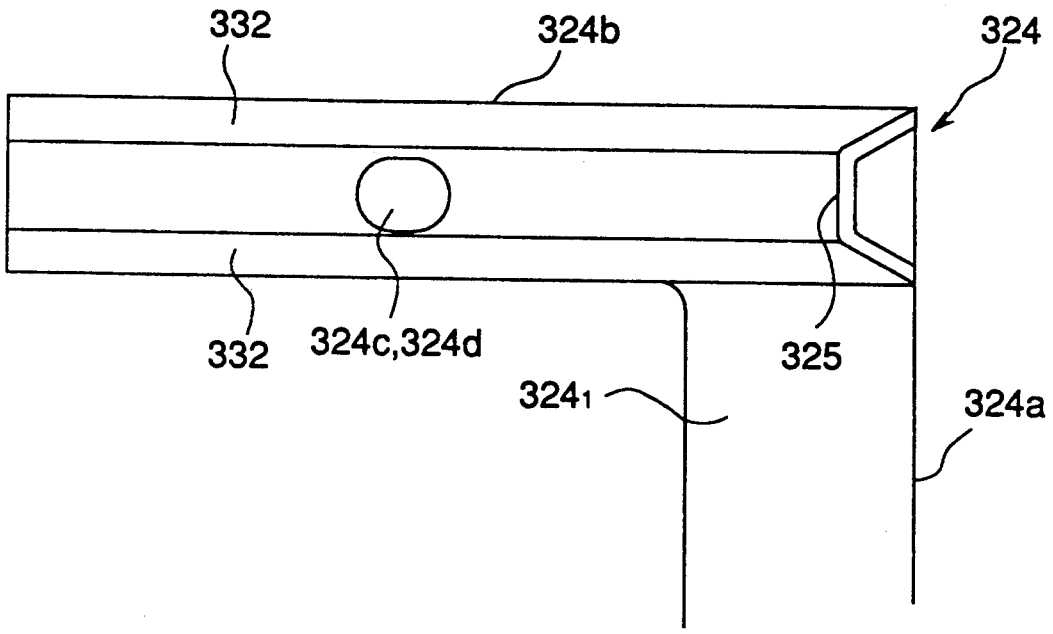
Figure 43:
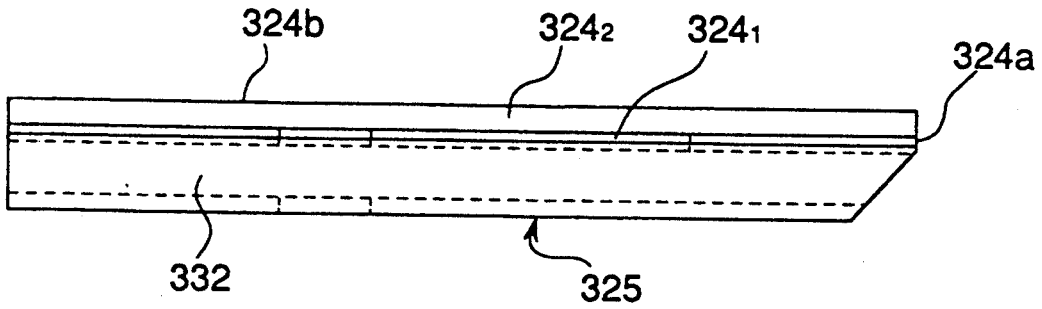
Figure 44:
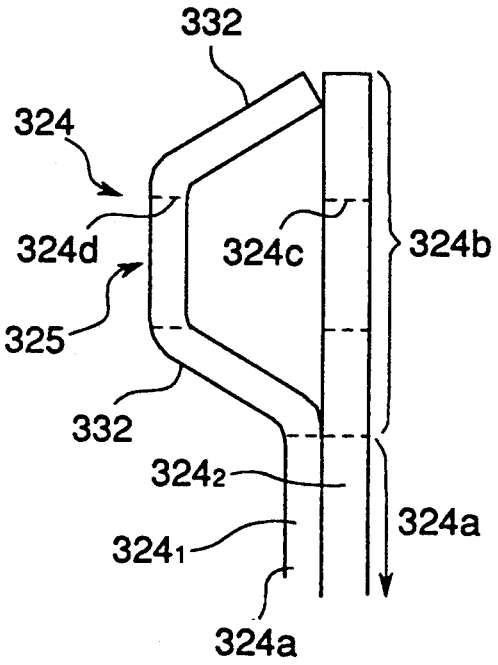

As shown in FIG. 27, the leg 302 comprises a framework 302a and a cover assembly 302b. As shown in FIGS. 27 and 38 to 41, the framework 302a comprises a support arm 321 made of an outer channel member 321a and an inner channel member 321b both upwardly open, the latter being fitted in and fixed to the former by spot welding to form a partially tubular member, a support base 322 made of an outer channel member 322a and an inner channel member 322b both downwardly open, the latter being fitted into and fixed to the former by spot welding to form a partially tubular member, and a tubular support post 323 inserted through the outer channel members 321a and 322a of the support arm 321 and the support base 322 to rigidly connect the inner channel members 321b and 322b thereof. As shown enlarged in FIG. 52, the upper edge surfaces $321a_1$ and $321b_1$ of the side walls of the outer and inner channel members 321a and 321b of the support arm 321 are formed into an upwardly facing surface. An arm 324 made of two plates $324_1$ and $324_2$ put together as shown in FIGS. 42 to 44 has its base portion 324a rigidly fixed to the upper end portion of the above-mentioned support post 323, and its upper horizontal portion 324b projecting above the upwardly facing surface $321a_1$, $321b_1$. A ridge 325 trapezoidal in transverse section is formed on the upper horizontal portion 324b of the plate $324_1$ at the user's side of the arm 324. On the other hand, as shown in FIGS. 27 and 45 to 48 the cover assembly 302b comprises a front cover 321d and a rear cover 321c which are applied onto the support arm 321 aslant from below, a front cover 322d and a rear cover 322c which are applied onto the support base 322 aslant from above, and a pair of middle covers 323a which are applied onto the support post 323 from right and left. With the front covers 321d and 322d and the rear covers 321c and 322c having been mounted on the support arm 321 and the support base 322, the middle covers 323b are fitted between the lower ends of the above-mentioned covers 321c and 321d and the upper ends of the above-mentioned covers 322c and 322d.

Figure 45:
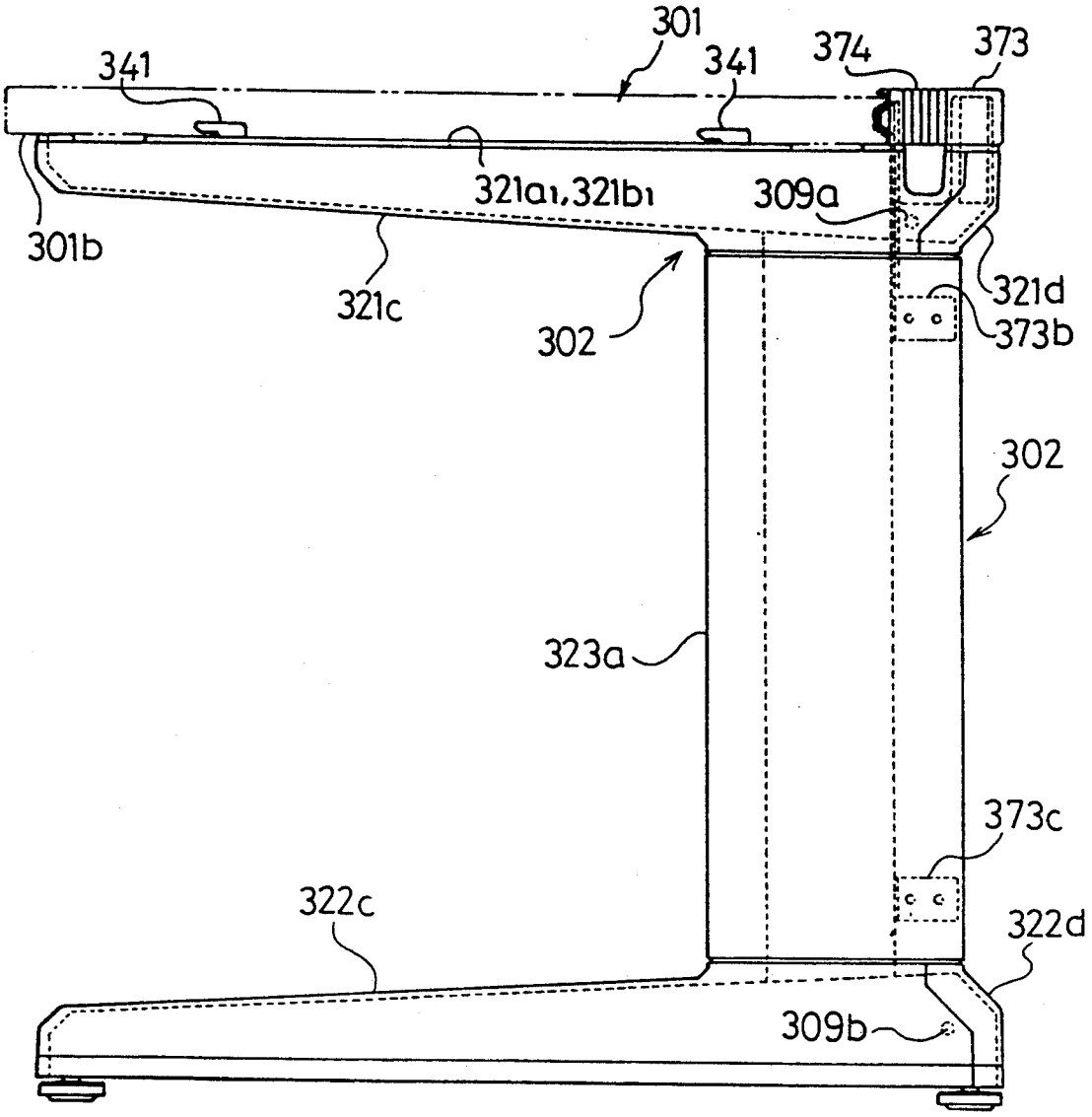
Figure 49:
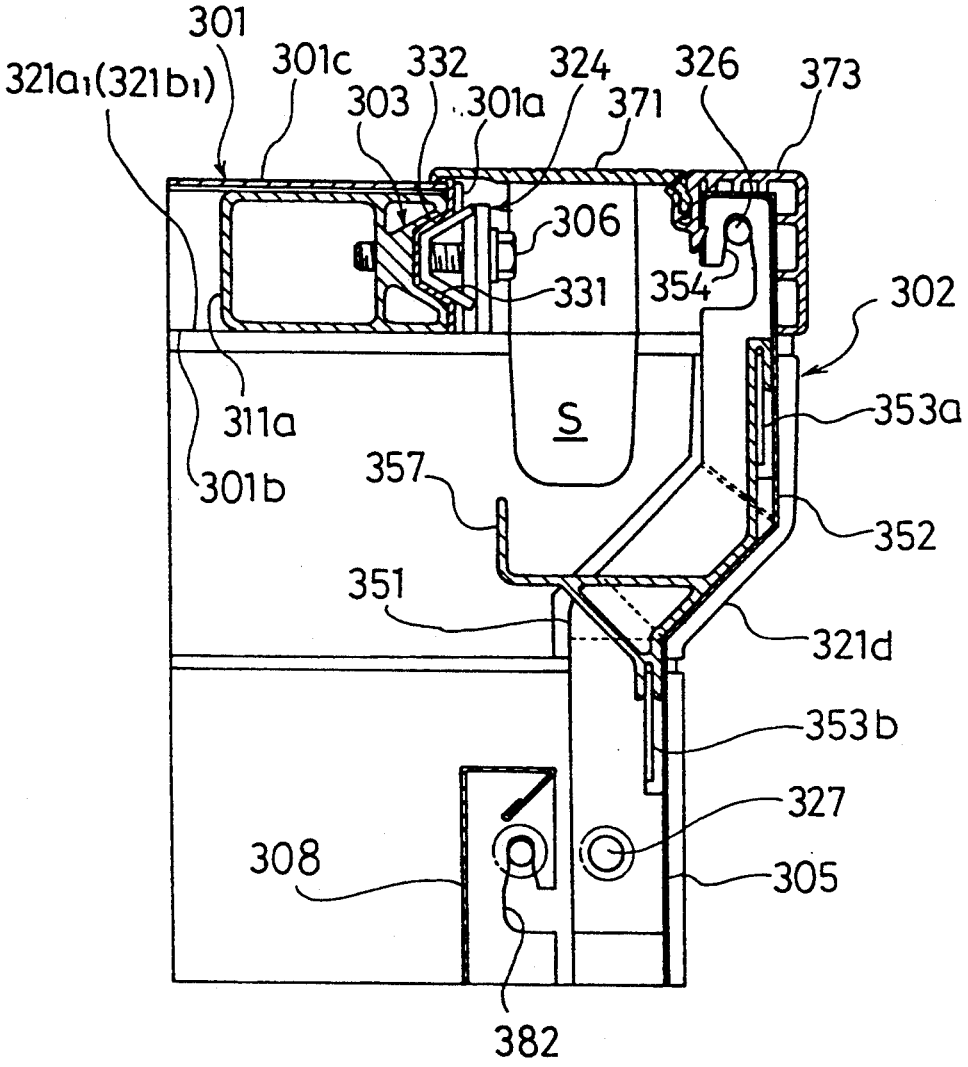
Figure 50:
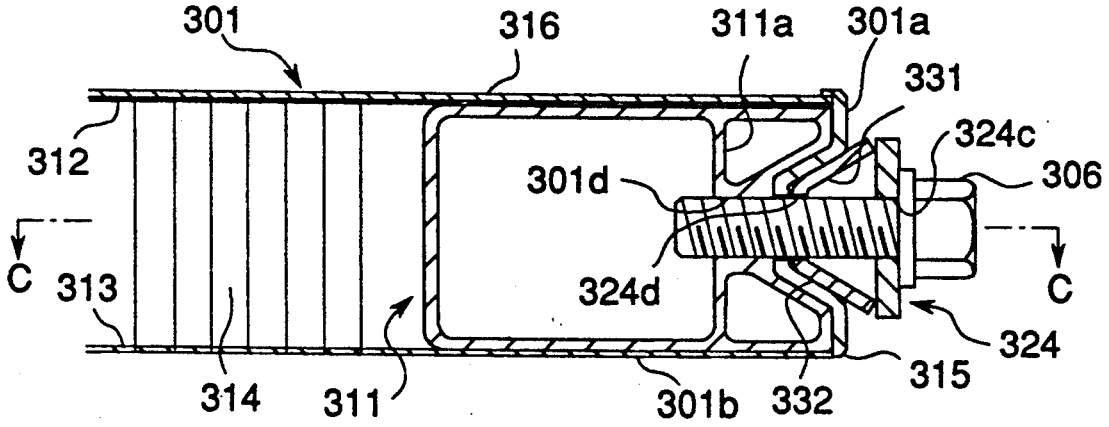
Figure 51:
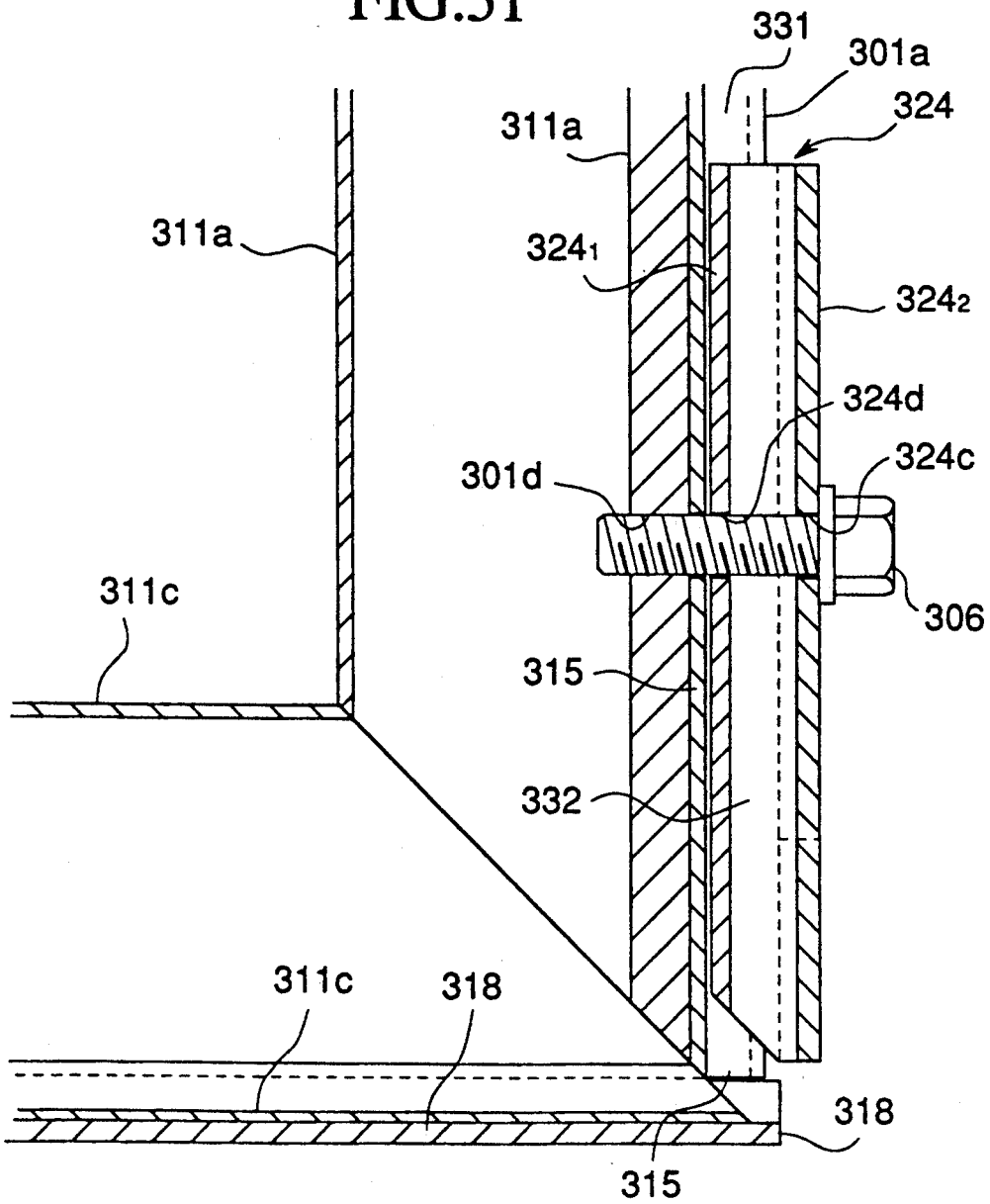

As shown in FIGS. 27 and 49, the tapered engaging means 303 comprises a concavely tapered surface 331 formed in the front edge 301*a* of the above-mentioned top plate 301 and a convexly tapered surface 332 formed on the arm 324 of the leg 302. The concavely tapered surface 331 is composed of the inclined surface of the trapezoidal groove 315*a* as shown in FIG. 36 while the convexly tapered surface 332 is composed of the inclined surface of the ridge 325 as shown in FIG. 44. With the under surface 301*b* of the top plate 301 having been placed on the upwardly facing surface 321*a*$_1$, 321*b*$_1$ of the leg 302 as shown in FIG. 45, the tapered surfaces 331 and 332 are set at the same level. Under the condition, by sliding the leg 302 relative to the top plate 301 toward the user's side the tapered surfaces 331 and 332 are brought into close contact with each other as shown in FIG. 49. At the position where the two tapered surfaces 331 and 332 closely contact each other, the holes 324*c* and 324*d* formed in the arm 324 for a bolt to be inserted through coincide with a threaded hole 301*d* formed in the front edge 301*a* as shown in FIGS. 50 and 51, so that a bolt 305 as a fastener may be inserted through the holes 324*c* and 324*d* to be screwed into the threaded hole 301*d*.

Figure 52:
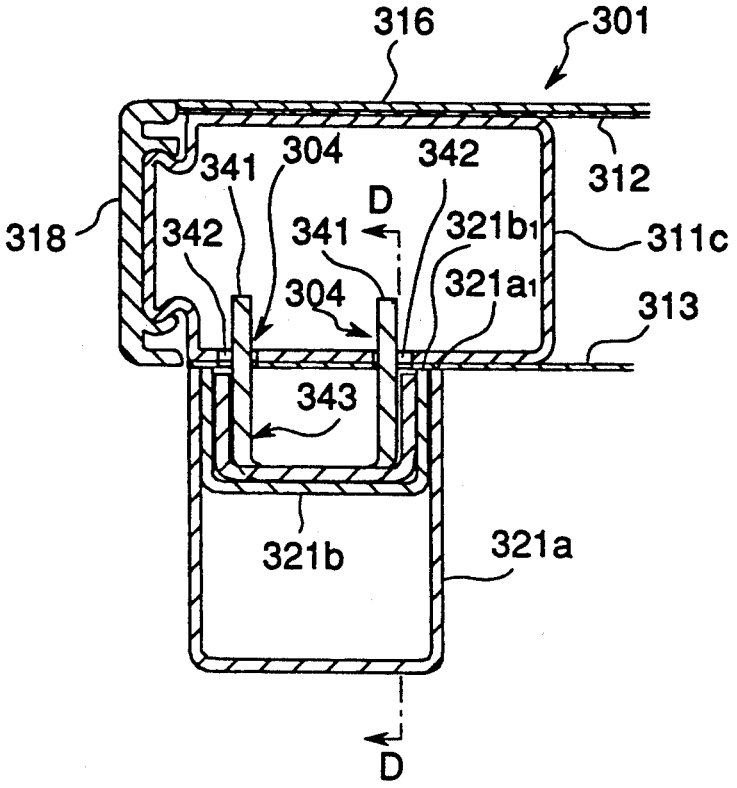
Figure 53:
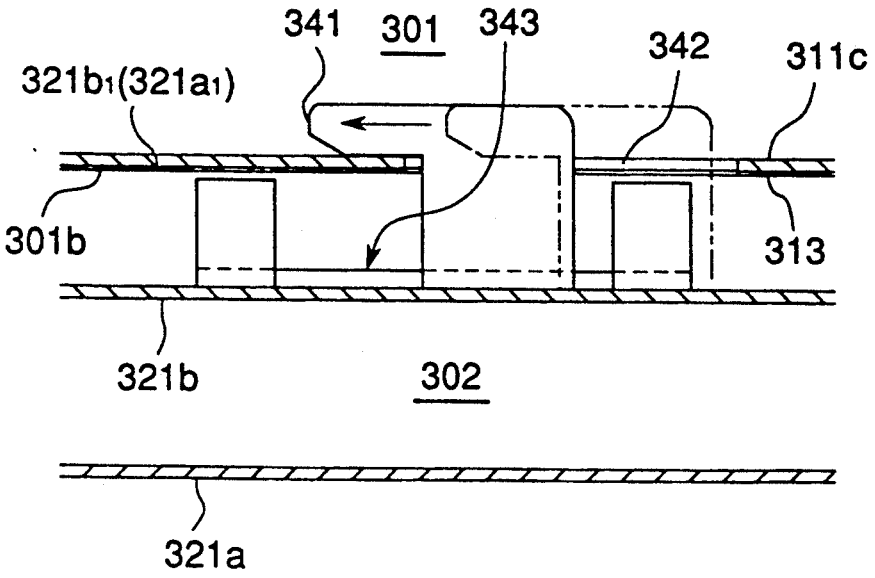

As shown in FIGS. 27, 33, 39 and 45, the claw-type engaging means 304 comprises bent claws 341 projecting from the upwardly facing surface 321*a*$_1$, 321*b*$_1$ of the leg 302, and claw-receiving holes 342 formed in the under surface 301*b* of the top plate 301. In particular, two metal plates 343 are fixed to the bottom wall of the inner channel member 321*b*. The metal plates 343 are so bent and formed that the claws 341 are formed in pairs at opposite positions spaced a predetermined distance from each other. The claws project above the upwardly facing surface 321*a*$_1$, 321*b*$_1$ so as to be bent toward the user's side. The claw-receiving holes 342 are formed in pairs at two positions corresponding to the above-mentioned paired bent claws 341 by punching out the bottom walls of the right and left frame members 311*c* and the steel plate 313. The lateral distance between each pair of holes 342 substantially corresponds to the lateral distance between the paired bent claws 341, and the longitudinal dimension of the holes 342 is slightly greater than the dimension in plane view of the bent claws 341. As shown in FIGS. 52 and 53, the leg 302 is displaced relative to the top plate 301 slightly forward from the normal position where the leg is fixed to the top plate, and the upwardly facing surface 321*a*$_1$, 321*b*$_1$ of the leg 321 is brought into close contact with the under surface of the top plates 301 thereby to insert the above-mentioned bent claws 341 through the claw-receiving holes 342 into the space inside the top plate 301, and from that position the leg 302 is slid relative to the top plate 301 toward the user's side thereby to bring the outer portions of the bent claws 341 into contact with the inner surface of the frame member 311*c*.

The above state of engagement of the claw-type engaging means 304 occurs simultaneously with the previously described state of engagement of the tapered engaging means 303.

Figure 46:
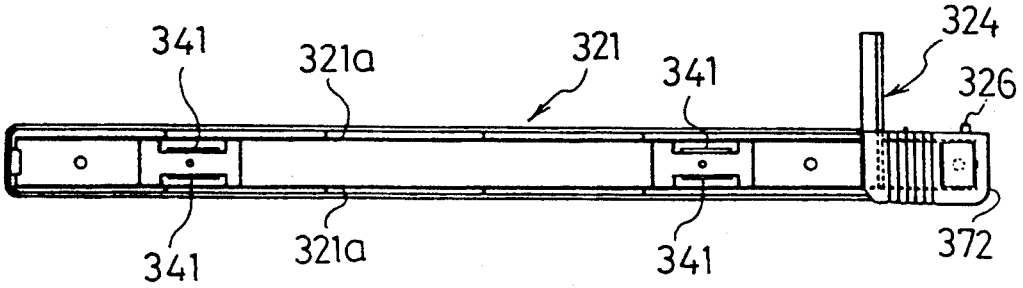
Figure 48:
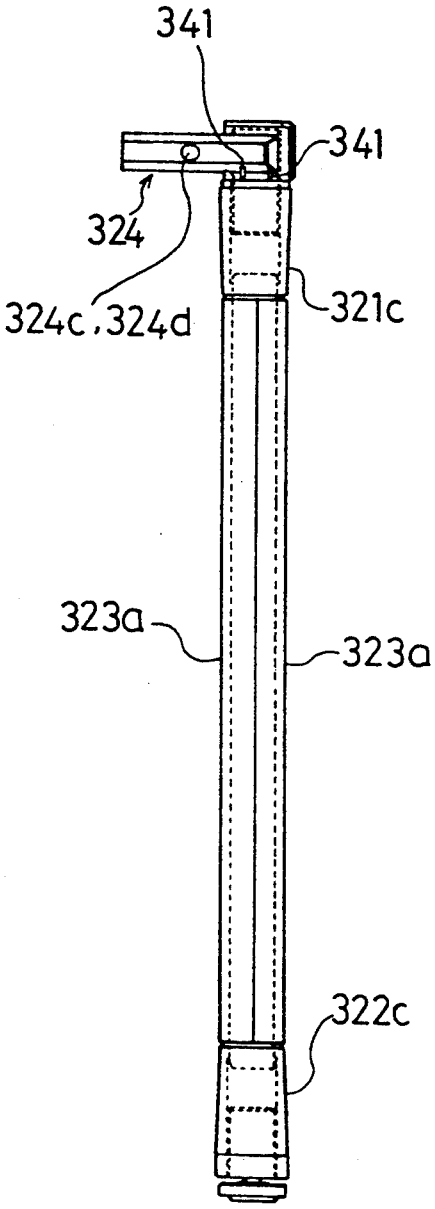
Figure 47:
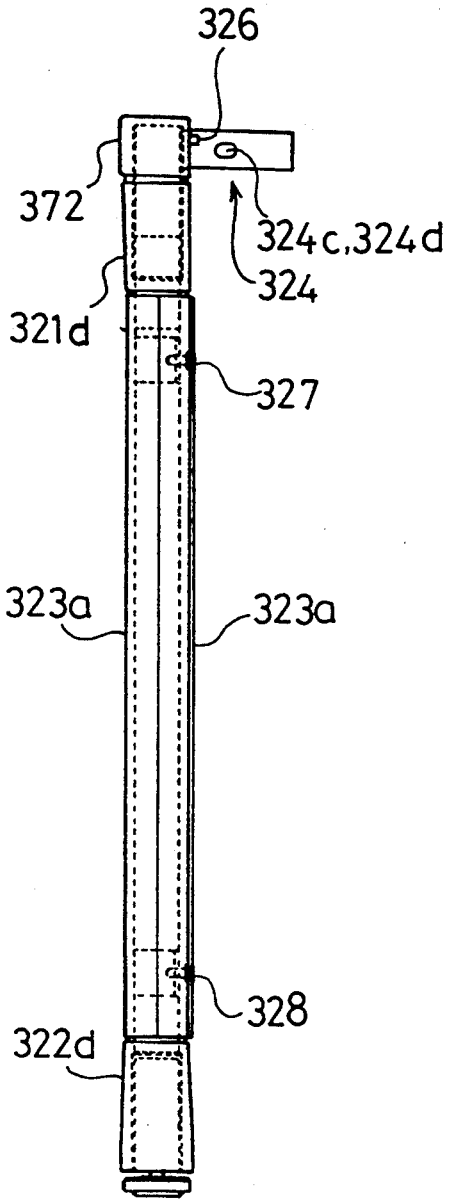
Figure 54:
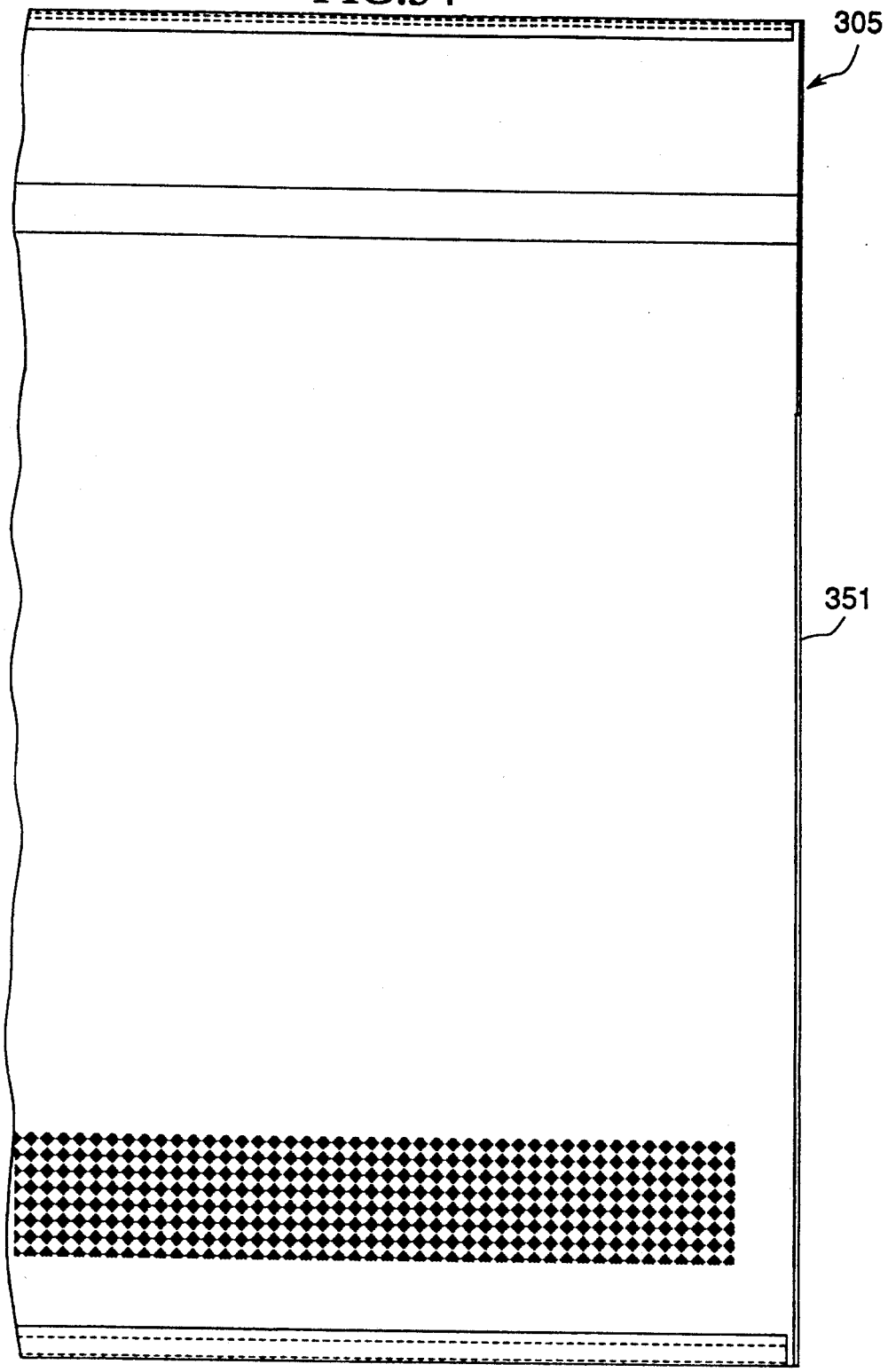
Figure 55:
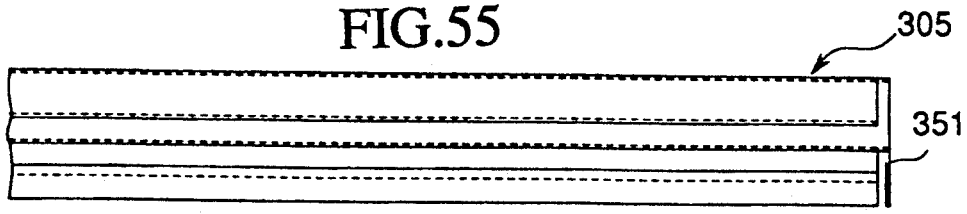
Figure 56:
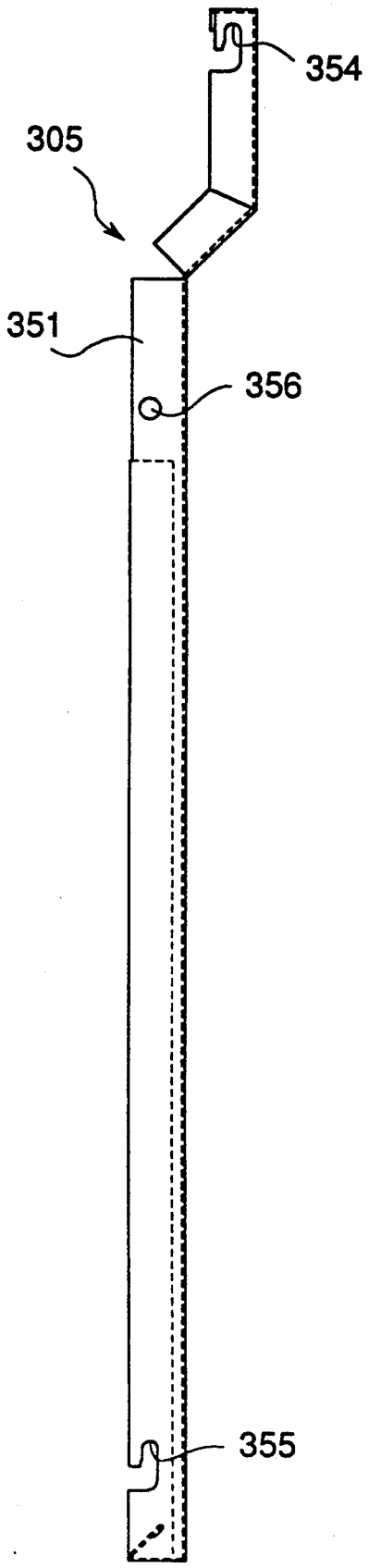
Figure 57:
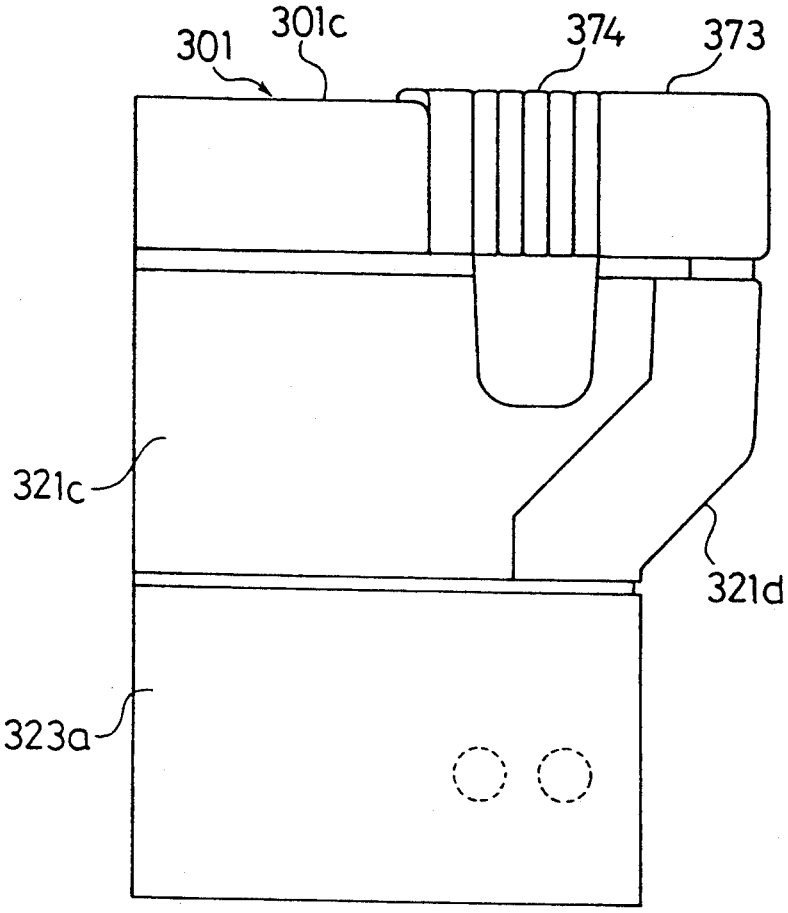
Figure 58:
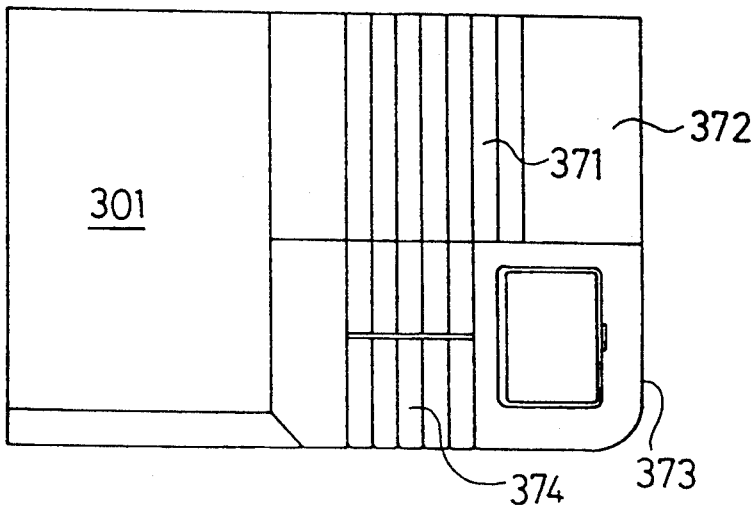
Figure 59:
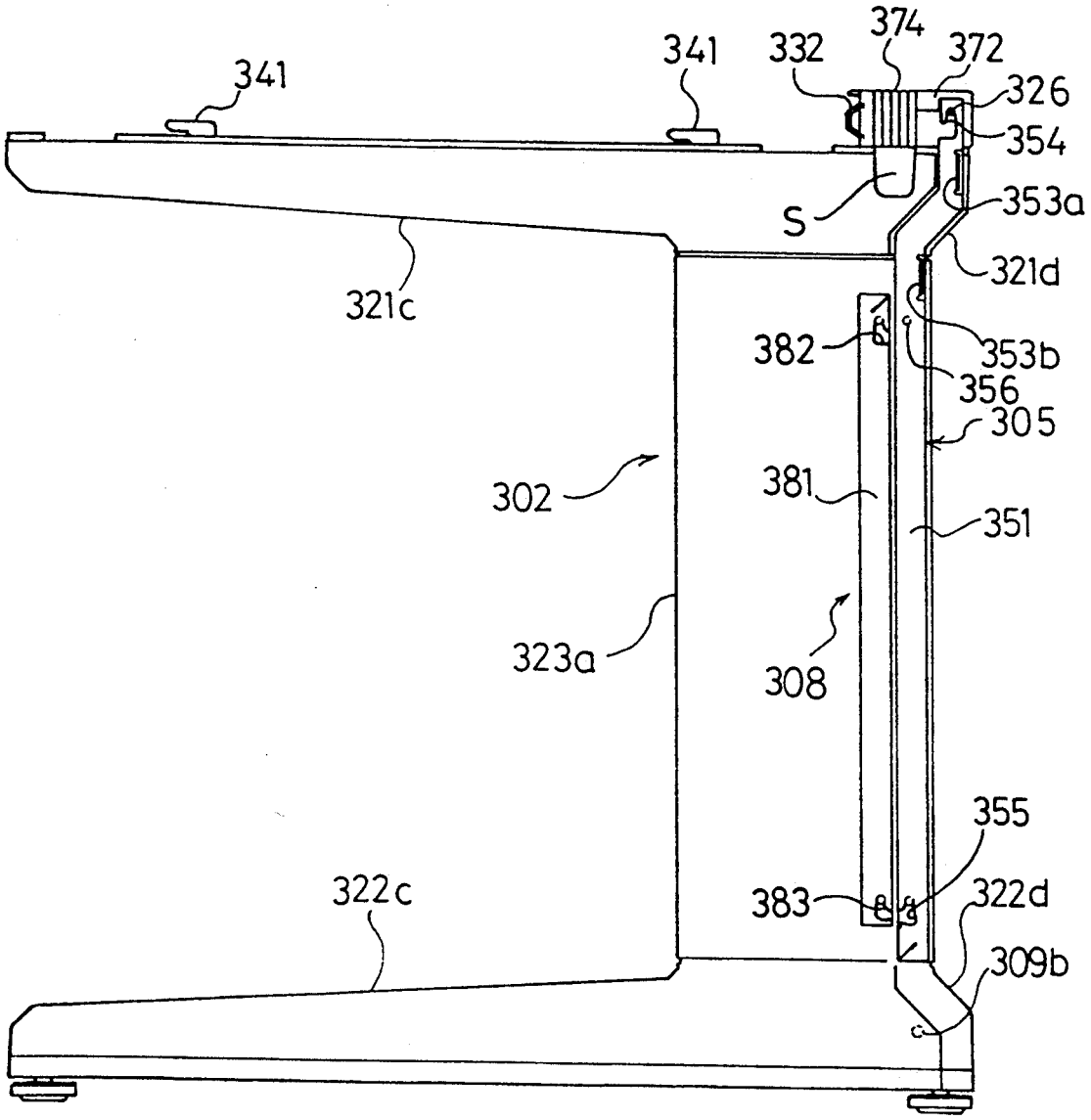
Figure 60:
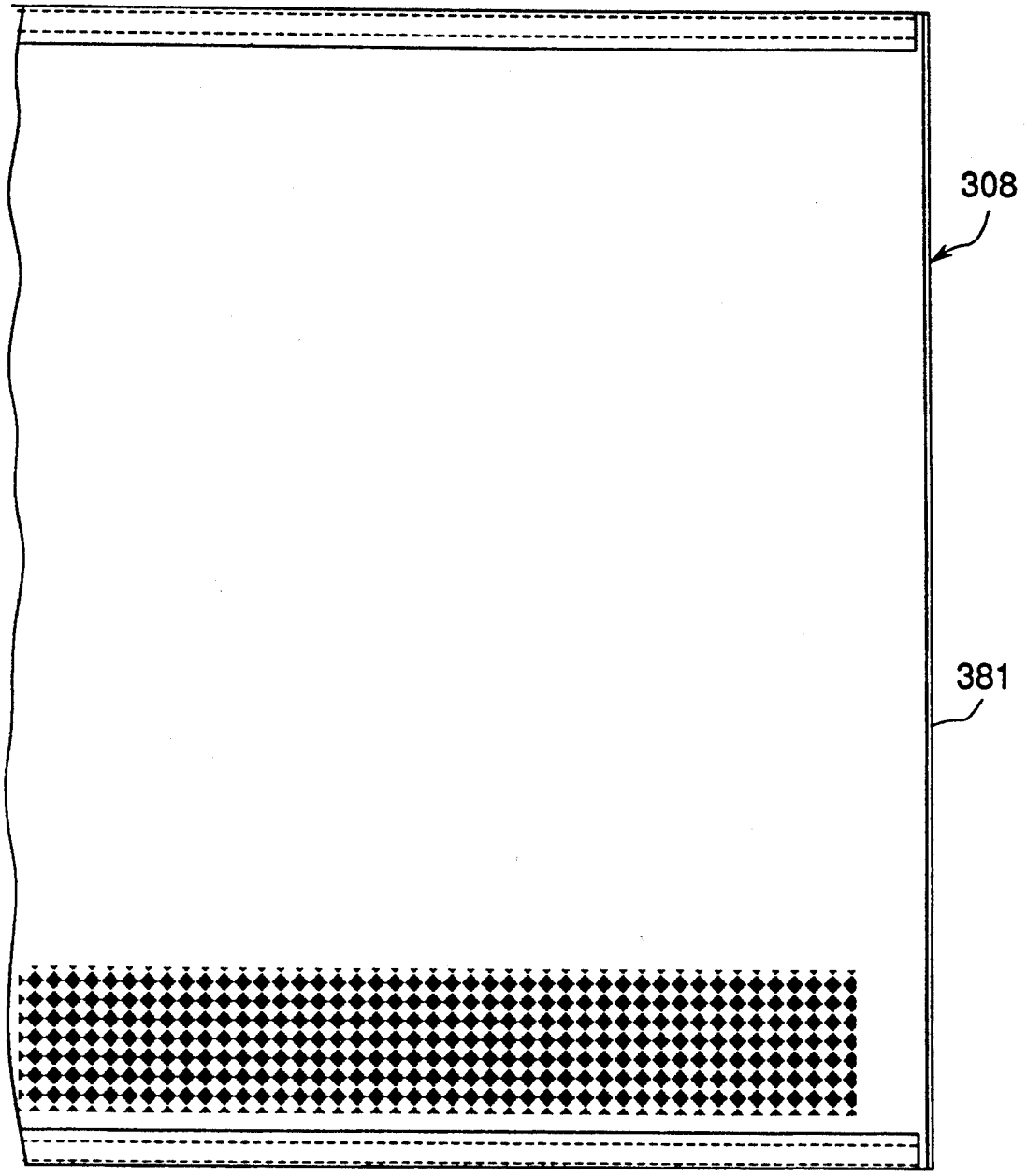
Figure 61:
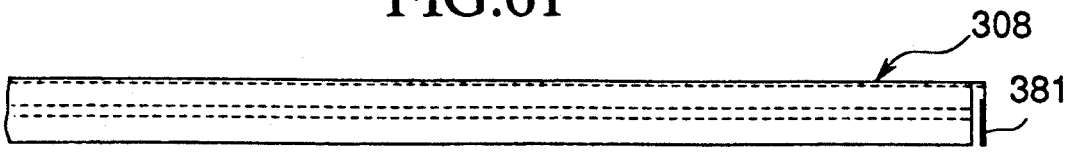
Figure 62:
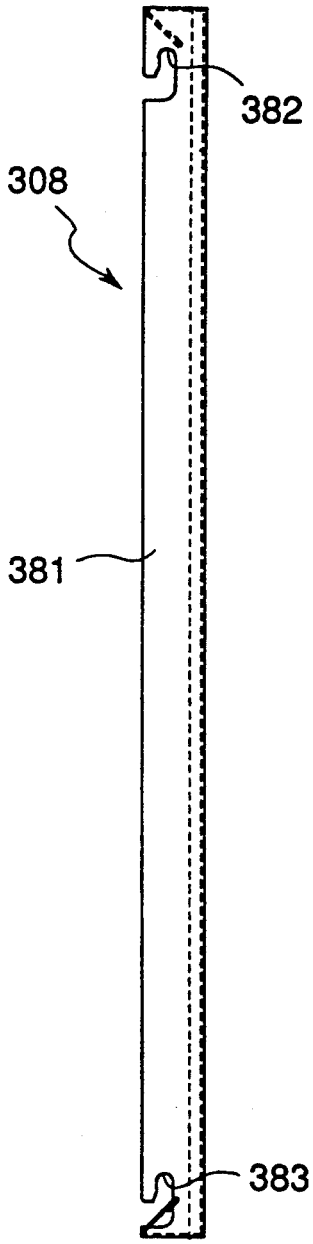

In this desk, at the state of engagement of the two engaging means 303 and 304 the bolt 306 securely fastens the top plate 301 to the leg 302 as shown in FIG. 49. Then the front panel 305 is provided outside the front edge 301*a* of the top plate 301. As shown in FIGS. 54 to 56, the front panel 305 comprises a steel plate, the right and left side portions of which are bent to form brackets 351, from which upper and lower tongues 353*a* and 353*b* extend along and inside the panel as shown in FIG. 49. A trough 357 is supported between the right and left tongues 353*a* and 353*a* and the right and left tongues 353*b* and 353*b*. The front panel 305 has a width approximately equal to the distance between the middle covers 323*a* of the right and left legs 302, and a height sufficient to substantially conceal the space under the top plate 301. The brackets 351 are formed with upper and lower recesses 354 and 555 and a hole 356 for a bolt to pass through. When the front panel 305 is mounted on the desk, the recess 354 is engaged by a stub 326 projecting from the leg 302 as shown in FIGS. 49 and 59, and bolts not shown but inserted through the recess 355 and the bolt-passing hole 356 are screwed into nuts 327 and 328 fixed to the leg 302 (cf. FIG. 47) thereby to fix the front panel 305 and at the same time form a space or duct S for containing cables or wires between the front panel and the front edge 301*a* of the top plate 301. In particular, as shown in FIGS. 45 to 47, the stub 326 is provided on the front cover 321*d* attached to the front side of the arm 321 of the leg 302, and the brackets 323*b* and 323*c* forwardly projecting from the front side of the post 323 are provided with fixed nuts 327*a* and 328*a* so that after the middle covers 323*a* have been fixed to the post, the nuts 327 and 328 may be screwed to the middle cover 323*a*.

In FIGS. 27, 29, 49, 57 and 58, the reference numeral 371 designates an upper lid which, when closed, makes a surface continuing from the surface 301*c* of the top plate and, when opened, upwardly opens the previously mentioned space S for containing wires or cables; the reference numeral 372 designates a cover for holding the upper lid 371 between the front edge 301*a* of the top plate 301 and the upper edge of the front panel 305; the reference numeral 373 designates a U-shaped frame forming a window which makes the above-mentioned cable-containing space S open laterally of the top plate 301; and the reference numeral 374 designates a lateral lid for opening and closing the window of the U-shaped frame. In FIGS. 49 and 59 to 62 the reference numeral 308 designates an interior plate made of steel, each side portion of which is bent to form a bracket provided at the upper and lower ends thereof with bolt-passing recesses 382 and 383. A bolt not shown is passed through each of the recesses 382 and 383 to be screwed into a nut fixed to the leg 302. The nuts 329 are screwed to the fixed nuts 329*a* provided on the previously mentioned brackets 323*b* and 323*c*.

Figure 38:
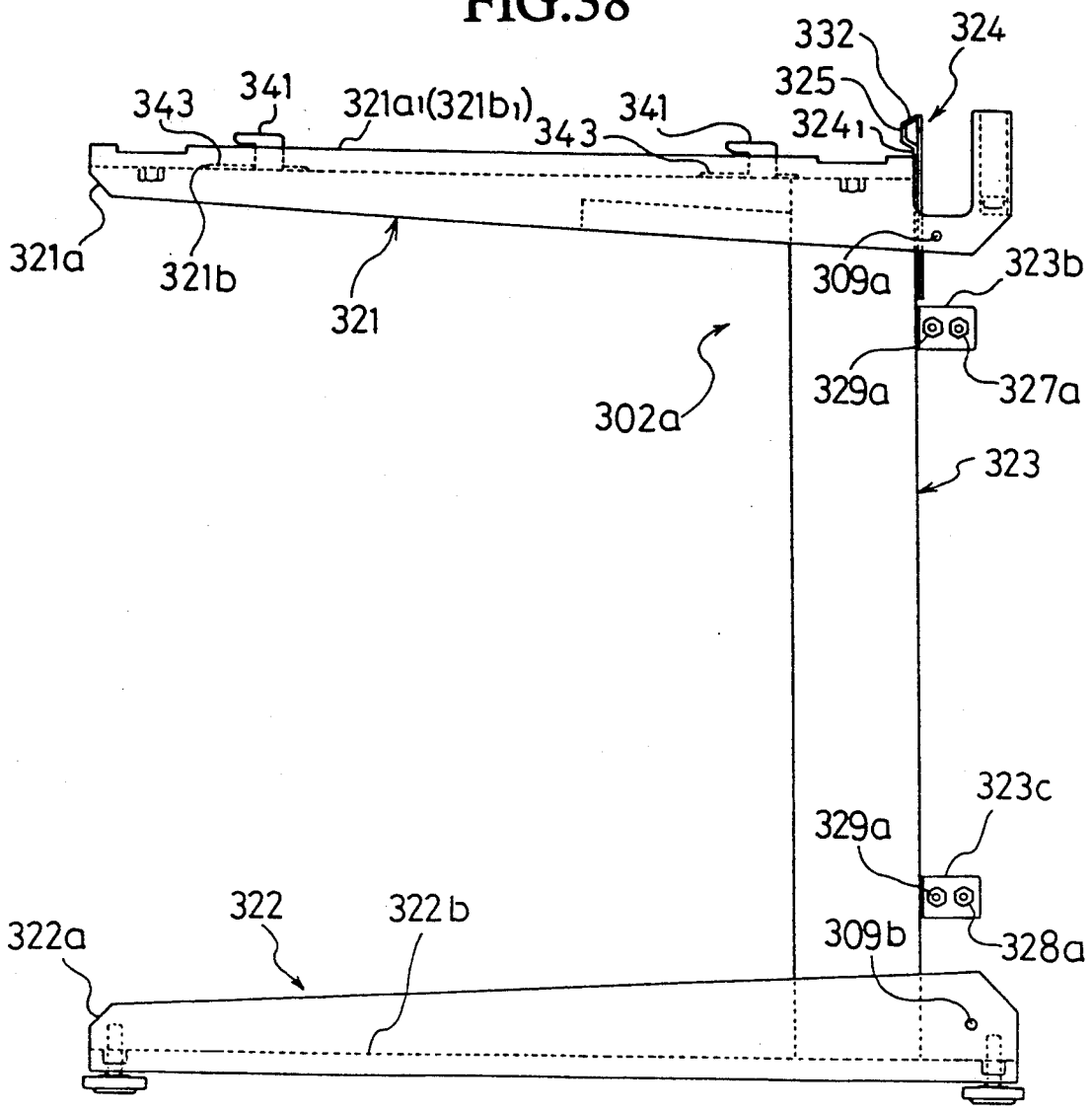
Figure 39:
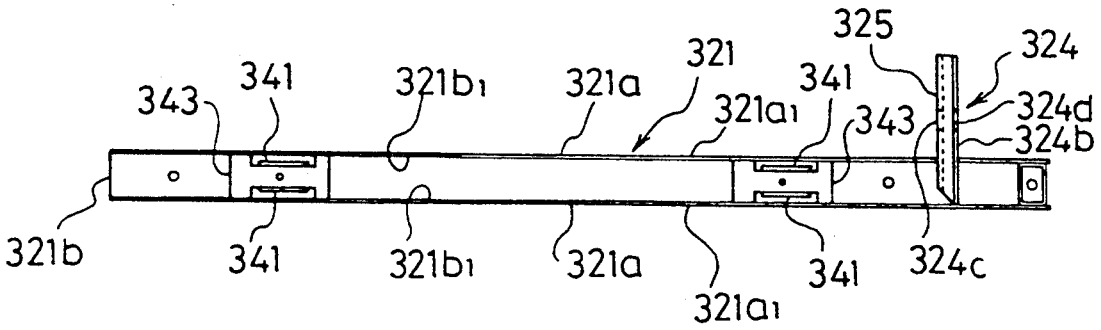
Figure 41:
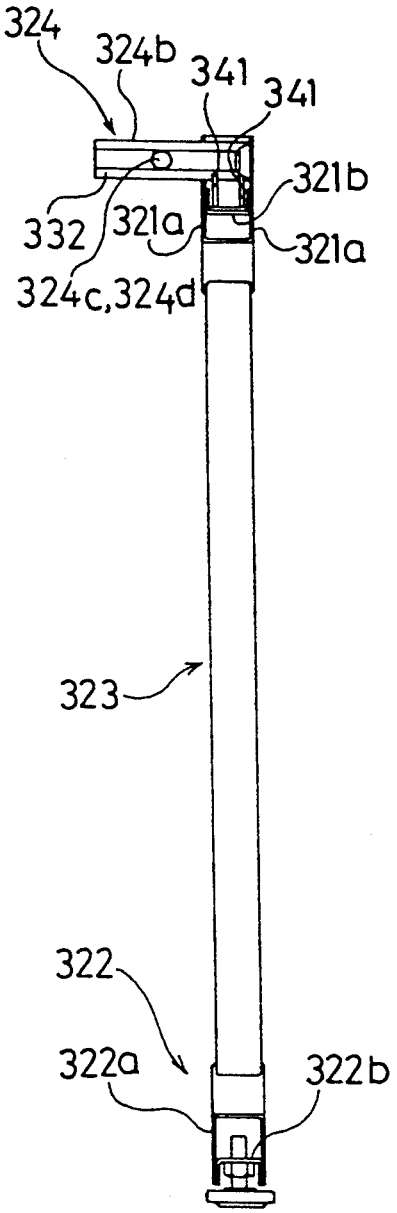
Figure 40:
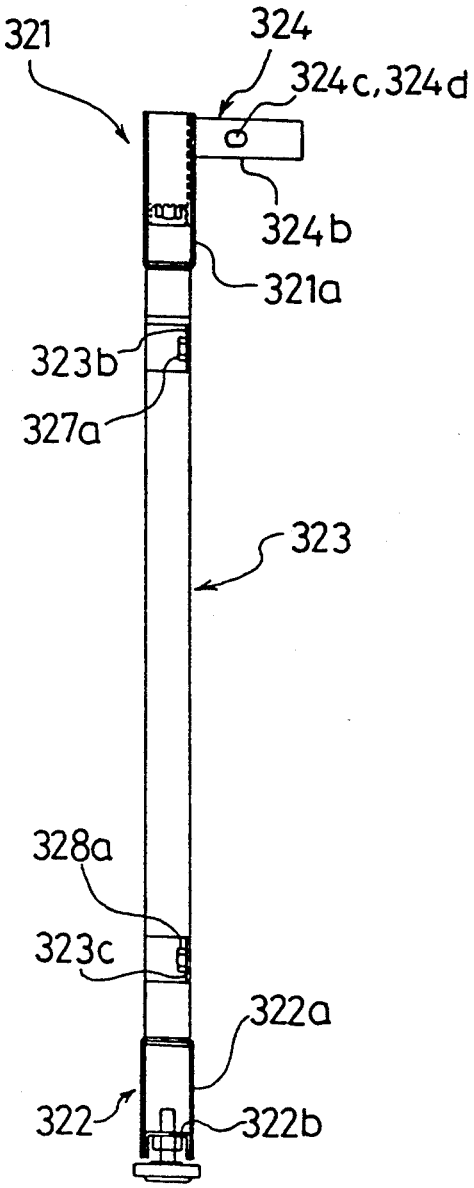

In FIG. 38 the reference numeral 309*a* designates a hole formed in the support arm 321 of the leg 302 so as to receive and hold a pin of resin not shown but projecting from the rear cover 321*c*; and the reference numeral 309*b* designates a hole formed in the support base 322 of the leg 302 so as to receive and hold a pin of resin not shown but projecting from the rear cover 322*c*.

The desk of the above construction can be assembled and disassembled quite easily. In particular, for assembly the under surface 301*b* of the top plate 301 is brought into contact with the upwardly facing surface 321*a*$_1$, 321*b*$_1$ of the leg 302, and under the condition the leg 302 is slid relative to the top plate 301 toward the user's side, whereupon the bent claws 341 of the claw-type engaging means 304 engage the holes 342 thereof, and at the same time the arm 324 on the leg 302 approaches the front edge 301*a* of the top plate 301 until the convexly tapered surface 332 of the tapered engaging means 303 contacts the concavely tapered surface 331 thereof. Under the condition, the arm 324 is fastened by the bolt 306 to the top plate 301, whereupon the convexly tapered surface 332 is fitted into the concavely tapered surface 331 thereby to fix the arm 324 to the top plate 301. Since the arm 324 is rigidly fixed to the leg 302, when the arm 324 has been securely connected to the top plate 301, the leg 302 becomes hard to be inclined relative to the top plate 301. Since the arm 324 is fixed to the front edge 301*a* of the top plate 301 to prevent the leg 302 from being displaced forwardly or rearwardly, the bent claws 341 will not be disengaged from the holes 342, so that the under surface 301*b* of the top plate 301 and the upwardly facing surface 321*a*$_1$, 321*b*$_1$ of the leg 302 will not be separated. The connection between the top plate 301 and the leg 302 can be released by reversing the above operation.

As described above, in this desk the top plate 301 is so constructed as to provide rigidity by itself, and with the top plate 301 as a basic component, the leg 302 is fixed to the top plate 30 by means of the tapered engaging means 303 and the claw-type engaging means 304 so as not to be inclinable or displaceable forwardly or rearwardly, so that two bolts 306 suffice to provide a sufficient degree of strength without the necessity of using many bolts to increase rigidity as in the prior art. As compared with known desks, the illustrated desk requires a reduced number of working steps for assembly and disassembly and yet can serve as an excellent desk which is solid and firm and hardly becomes loose.

In addition, the desk is provided along the through 357 between the front edge 301*a* of the top plate 301 and the front panel 305 with the cable-containing space S, which can be made open upwardly at a proper position through the plurality of upper lids 371. With this arrangement, it is possible to conceal the tapered engaging means 303 with the front panel 305 and to put wires or cables from on the top plate 301 into the space S at a desired position along the front edge 301*a* thereby to eliminate the inconvenience experienced when office machines are used on known desks. In this embodiment, the above-mentioned space S can be made open laterally through the right and left lids 374, so that when a plurality of top plates 301 are connected side by side, the spaces S in adjacent desks are continuously connected thereby to enable wiring more efficiently than otherwise. Since the leg 302 is composed of the framework 302*a* and the cover 302*b*, and the framework 302*a* in turn is composed of the channel members 321*a*, 321*b*, 322*a*, 322*b* and the post 323, so that the leg 302 may be formed into a desired contour with ease and without particular machining, and a sufficient degree of rigidity can be obtained by spot welding. Since the leg is covered by the cover assembly 302*b* of hard synthetic resin, the exterior of the leg can be finished or changed easily and does not give to the touch a feeling so cool as metal.

The component parts are not limited to the illustrated constructions, but there may be various modifications and changes without departing from the scope of the invention.

FIELD OF USE IN INDUSTRY

As described above, the desk of the invention is useful in offices, etc.

We claim:

1. A desk characterized by comprising a top plate, legs, tapered engaging means and claw-type engaging means; wherein the top plate has rigidity; each of the legs is provided with an upwardly facing surface adapted to be in contact with a under surface of the top plate, and at a upper end of said leg an arm extending along a front edge of the top plate; the tapered engaging means comprises a concavely tapered surface formed in either one of the front edge of the top plate and the arm of each of the legs, and a convex surface formed on the other of the front edge and the arm, the tapered engaging means being so constructed that the concavely tapered surface and the convexly tapered surface can be brought into close contact with each other by sliding each of the legs relative to the top plate; the claw-type engaging means comprises claws formed on either one of the under surface of the top plate and a upwardly facing surface of each of the legs, and claw-receiving holes formed in the other of the under surface and the upwardly facing surface, the claw-type engaging means being so constructed that the claws can be brought into engagement in the holes by inserting the claws into the holes and sliding each of the legs relative to the top plate; and when the engaging means are engaged, the arm is securely fixed by a fastener to the front edge of the top plate.

2. The desk described in claim 1 and characterized in that the top plate comprises a frame and metal plates fixed to the upper and under sides of the top plate frame.

3. The desk described in claim 1 and characterized in that the top plate is provided on the under surface of a steel plate with hollow reinforcing cross members.

4. The desk described in claim 3 and characterized in that the claw-receiving holes are formed in the reinforcing members of the top plate.

5. The desk described in claim 1 and characterized in that the top plate is wooden and is provided with an edge member made of metal forming a front edge of the top plate.

6. The desk described in claim 5 and characterized in that the top plate is formed with recesses, and a metal plate is fixed to the top plate to close the recesses, with the claw-receiving holes formed in the metal plate at positions which correspond to the recesses.

7. The desk described in claim 1 and characterized in that the concavely tapered surface is formed as a V-shaped groove formed in the front edge of the top plate, and the convexly tapered surface is formed as a ridge formed on the arm.

8. The desk described in claim 1 and characterized in that the concavely tapered surface is formed as a V-shaped groove formed in the arm, and the convexly tapered surface is formed as a ridge formed on the front edge of the top plate.

9. The desk described in claim 1 and characterized in that the claws are provided on the upwardly facing surface of each of the legs so as to project therefrom, and the claw-receiving holes are formed in the under surface of the top plate.

10. The desk described in claim 1 and characterized in that the claws are provided on the under surface of the top plate so as to project therefrom, and the claw-receiving holes are formed in the upwardly facing surface of each of the legs.

11. The desk described in claim 1 and characterized in that the fastener is a bolt inserted through the arm to be screwed into a threaded hole formed in the top plate thereby to fix the arm to the top plate.

12. The desk described in claim 1 and characterized in that the claws are provided in pairs on the upwardly facing surface of the leg, the claws in each pair being spaced a predetermined pitch from each other widthwise of the top plate, and the claw-receiving holes are formed in the under surface of the top plate in pairs, the two claws in each pair being spaced ½ and 3/2 of the pitch, respectively, from each lateral side edge of the top plate.

13. The desk described in claim 1 and characterized in that the claw-receiving holes are formed in the upwardly facing surface of each of the legs in pairs, the holes in each pair being spaced a predetermined pitch from each other widthwise of the top plate, and each of the claws is provided on the under surface of the top plate at a position corresponding to ½ of the pitch from each lateral side edge of the top plate.

14. The desk described in claim 13 and characterized in that additional claws are provided on the under surface of the top plate at positions corresponding to 3/2 of the pitch from each lateral side edge of the top plate.

15. The desk described in claim 1 and characterized in that a front panel is provided in front of the front edge of the top plate so that a cable-containing space which can be opened and closed is formed between the front panel and the front edge.

16. The desk described in claim 15 and characterized in that between the front edge of the top plate and the upper edge of the front panel there is provided a lid which, when closed, becomes continuous with the top plate and, when opened, opens the cable-containing space upwardly.

17. The desk described in claim 15 and characterized in that a trough which forms the bottom wall of the cable-containing space is fixed to the inner surface of the front panel.

18. The desk described in claim 15 and characterized in that between the front edge of the top plate and each of the lateral edges of the front panel there is provided a lateral lid which, when closed, becomes continuous with the outer lateral surface of each of the legs and, when opened, opens the cable-containing space laterally.

19. The desk described in claim 1 and characterized in that each of the legs comprises a framework made of steel and comprising a support base to be placed on the floor and a support arm connected through a post to the support base and formed with an upwardly facing surface, and a cover assembly made of synthetic resin for covering the outer surface of the framework.

20. The desk described in claim 19 and characterized in that the support arm comprises an upwardly open inner channel member fitted into and welded to an upwardly open outer channel member to form a partially tubular member, and the support base comprises a downwardly open inner channel member fitted into and welded to a downwardly open outer channel member to form a partially tubular member.

21. The desk described in claim 19 and characterized in that the cover assembly comprises a front cover and a rear cover to be attached to the support arm from below, a front cover and a rear cover to be attached to the support base from above, and middle covers to be attached to the post from both lateral sides; the middle covers being engaged with the front and rear covers which have been attached to the support arm and the support base.

* * * * *